US011970758B2

(12) United States Patent
Shuto et al.

(10) Patent No.: US 11,970,758 B2
(45) **Date of Patent: *Apr. 30, 2024**

(54) HOT-ROLLED STEEL SHEET

(71) Applicant: NIPPON STEEL CORPORATION, Tokyo (JP)

(72) Inventors: Hiroshi Shuto, Tokyo (JP); Akifumi Sakakibara, Tokyo (JP); Shinsuke Kai, Tokyo (JP); Koutarou Hayashi, Tokyo (JP); Hiroshi Kaido, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 456 days.

This patent is subject to a terminal disclaimer.

(21) Appl. No.: 17/285,428

(22) PCT Filed: Oct. 21, 2019

(86) PCT No.: PCT/JP2019/041330

§ 371 (c)(1),
(2) Date: Apr. 14, 2021

(87) PCT Pub. No.: WO2020/080554

PCT Pub. Date: Apr. 23, 2020

(65) Prior Publication Data

US 2021/0381086 A1 Dec. 9, 2021

(30) Foreign Application Priority Data

Oct. 19, 2018 (JP) ..... 2018-197937

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/26*** | (2006.01) |
| ***C22C 38/34*** | (2006.01) |
| ***C22C 38/38*** | (2006.01) |

(52) U.S. Cl.

CPC ..... *C22C 38/38* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/26* (2013.01); *C22C 38/34* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 6,544,354 | B1 | 4/2003 | Kawano et al. | |
| 11,492,679 | B2 * | 11/2022 | Yokoi | C22C 38/008 |
| 2016/0273066 | A1 | 9/2016 | Sakakibara et al. | |
| 2019/0003009 | A1 | 1/2019 | Kawata et al. | |

(Continued)

FOREIGN PATENT DOCUMENTS

| | | | |
|---|---|---|---|
| CN | 108495943 | A | 9/2018 |
| JP | 59-219473 | A | 12/1984 |

(Continued)

OTHER PUBLICATIONS

"Hot-rolled steel sheet and strip for automobile use", The Japan Iron and Steel Federation Standard, JFS T 1001: 1996 (JFS A 1001: 2014), pp. 1-22, total of 26 pages.

(Continued)

*Primary Examiner* — Jophy S. Koshy

(74) *Attorney, Agent, or Firm* — Birch, Stewart, Kolasch & Birch, LLP

(57) ABSTRACT

This hot-rolled steel sheet has a predetermined chemical composition. The metallographic structure at a sheet thickness ¼ depth from a surface and at a center position in a sheet width direction in a sheet width cross section parallel to a rolling direction contains, by area %, 77.0% to 97.0% of bainite and tempered martensite in total, 0% to 5.0% of ferrite, 0% to 5.0% of pearlite, 3.0% or more of residual austenite, and 0% to 10.0% of martensite. The average grain size of the metallographic structure excluding the residual austenite is 7.0 μm or less. The C concentration in the residual austenite is 0.5 mass % or more. The number density of iron-based carbides having a diameter of 20 nm or more is $1.0\times10^6$ carbides/mm$^2$ or more.

5 Claims, No Drawings

(56) References Cited

U.S. PATENT DOCUMENTS

| | | | | |
|---|---|---|---|---|
| 2020/0157666 | A1 | 5/2020 | Sakakibara et al. | |
| 2020/0165708 | A1* | 5/2020 | Hasegawa | C22C 38/001 |
| 2022/0010396 | A1* | 1/2022 | Yokoi | C21D 9/46 |

FOREIGN PATENT DOCUMENTS

| | | | | |
|---|---|---|---|---|
| JP | 11-61326 | A | 3/1999 | |
| JP | 2005-179703 | A | 7/2005 | |
| JP | 2012-251200 | A | 12/2012 | |
| JP | 2015-124410 | A | 7/2015 | |
| JP | 6132017 | B2 | 5/2017 | |
| WO | WO-2017138384 | A1 * | 8/2017 | C21D 8/0226 |
| WO | WO 2018/033960 | A1 | 2/2018 | |
| WO | WO 2018/115935 | A1 | 6/2018 | |

OTHER PUBLICATIONS

"Metallic materials—Tensile testing—Method of test at room temperature", JIS Z 2241: 2011, pp. 477-549.
"Method for Charpy pendulum impact test of metallic materials", JIS Z 2242: 2005, pp. 364-375.

* cited by examiner

HOT-ROLLED STEEL SHEET

TECHNICAL FIELD OF THE INVENTION

The present invention relates to a hot-rolled steel sheet. Specifically, the present invention relates to a hot-rolled steel sheet that is formed into various shapes by press working or the like to be used, and particularly relates to a hot-rolled steel sheet that has high strength and has excellent ductility and stretch flangeability.

The present application claims priority based on Japanese Patent Application No. 2018-197937, filed in Japan on Oct. 19, 2018, the content of which is incorporated herein by reference.

RELATED ART

In recent years, from the viewpoint of protecting the global environment, efforts have been made to reduce the amount of carbon dioxide gas emitted in many fields. Vehicle manufacturers are also actively developing techniques for reducing the weight of vehicle bodies for the purpose of reducing fuel consumption. However, it is not easy to reduce the weight of vehicle bodies since the emphasis is placed on improvement in collision resistance to secure the safety of the occupants.

Here, in order to achieve both vehicle body weight reduction and collision resistance, an investigation has been conducted to make a member thin by using a high strength steel sheet. Therefore, steel sheets having both high strength and excellent formability are strongly desired, and some techniques have been conventionally proposed in order to meet these demands. Among these, steel sheets containing residual austenite exhibit excellent ductility by transformation-induced plasticity (TRIP), and therefore many investigations have been conducted so far.

For example, Patent Document 1 discloses a high strength steel sheet for a vehicle having excellent collision resistant safety and formability, in which residual austenite having an average grain size of 5 μm or less is dispersed in ferrite having an average grain size of 10 μm or less. In the steel sheet containing residual austenite in the metallographic structure, while the austenite is transformed into martensite during working and large elongation is exhibited due to transformation-induced plasticity, the formation of hard martensite impairs hole expansibility. Patent Document 1 discloses that not only the ductility but also hole expansibility are improved by refining the ferrite and the residual austenite.

Patent Document 2 discloses a high strength steel sheet having excellent elongation and stretch flangeability and having a tensile strength of 980 MPa or more, in which a second phase constituted of residual austenite and/or martensite is finely dispersed in crystal grains.

Patent Documents 3 and 4 disclose a high strength hot-rolled steel sheet having excellent ductility and stretch flangeability, and a method for manufacturing the same. Patent Document 3 discloses a method for manufacturing a high strength hot-rolled steel sheet having good ductility and stretch flangeability, and is a method including cooling a steel sheet to a temperature range of 720° C. or lower within 1 second after the completion of hot rolling, retaining the steel sheet in a temperature range of higher than 500° C. and 720° C. or lower for an incubation time of 1 to 20 seconds, and then the coiling the steel sheet in a temperature range of 350° C. to 500° C. In addition, Patent Document 4 discloses an high-strength hot-rolled steel sheet that has good ductility and stretch flangeability and includes bainite as a primary phase and an appropriate amount of polygonal ferrite and residual austenite, in which in a steel structure excluding the residual austenite, an average grain size of grains surrounded by grain boundaries having a crystal orientation difference of 15° or more is 15 μm or less.

Patent Document 5 discloses a hot-rolled steel sheet having excellent strength and low temperature toughness and containing granular tempered martensite at a volume fraction of 90% or more or containing both granular tempered martensite and granular lower bainite at a total volume fraction of 90% or more, in which an average aspect ratio of effective crystal grains of the tempered martensite and the lower bainite is 2 or less, an effective grain size of the tempered martensite and the lower bainite is 10 μm or less, the steel sheet has a structure in which iron-based carbides are present at a density of $1\times10^6$ (carbides/mm$^2$) or more in the tempered martensite and the lower bainite, and a galvanized layer or an alloyed galvanized layer is provided on a surface.

PRIOR ART DOCUMENT

[Patent Document]

[Patent Document 1] Japanese Unexamined Patent Application, First Publication No. H11-61326

[Patent Document 2] Japanese Unexamined Patent Application, First Publication No. 2005-179703

[Patent Document 3] Japanese Unexamined Patent Application, First Publication No. 2012-251200

[Patent Document 4] Japanese Unexamined Patent Application, First Publication No. 2015-124410

[Patent Document 5] Japanese Patent No. 6132017

DISCLOSURE OF THE INVENTION

Problems to be Solved by the Invention

Since there are various working methods for vehicle components, the required formability differs depending on members to which the working methods are is applied, but among these, ductility and stretch flangeability are placed as important indicators for formability. It is desired that vehicle components have both ductility and stretch flangeability at a high level. In addition, it is desirable that a steel sheet containing residual austenite also have ductility and stretch flangeability at a high level. However, precise temperature control is required in the manufacturing step and there is a problem that the material property variation is large in the sheet width direction when actually manufactured.

The high strength steel sheet for a vehicle disclosed in Patent Document 1 has improved ductility and hole expansibility due to refinement of ferrite and residual austenite. However, the maximum hole expansion ratio obtained is 1.5, and it is hard to say that the steel sheet has sufficient press formability. In addition, in order to increase the work hardening index and improve the collision resistant safety, it is necessary to use soft ferrite as a primary phase, and thus high tensile strength may not be obtained.

In the high strength steel sheet disclosed in Patent Document 2, it is necessary to contain a large amount of expensive elements such as Cu and Ni or to perform a solutionizing treatment at a high temperature for a long period of time to refine the second phase to nano size and disperse the second phase within the crystal grains. Thus, an increase in manufacturing cost or a decrease in productivity may be remarkable.

In the method for manufacturing a high strength hot-rolled steel sheet disclosed in Patent Document 3, rapid cooling at a cooling rate of several 100° C./s or higher is continued up to a temperature near 700° C., and thus, the sheet temperature cannot be easily controlled in the mass production step in some cases.

Although the high strength hot-rolled steel sheet disclosed in Patent Document 4 has high strength and good ductility and stretch flangeability, it is necessary to control the structural nonuniformity in the sheet thickness direction, and it is presumed that the yield may be significantly decreased in the mass production step.

Since the hot-rolled steel sheet disclosed in Patent Document 5 is manufactured under a condition that the coiling temperature is 100° C. or higher and lower than 400° C. and the incubation time in the temperature range where residual austenite is formed is not sufficiently secured, the strength and the ductility (TS-EL balance) may not be excellent.

The present invention has been made in view of the above problems of the related art, and an object of the present invention is to provide a hot-rolled steel sheet having high strength and excellent ductility and stretch flangeability. More preferably, an object of the present invention to provide a hot-rolled steel sheet having the above-mentioned properties and having a material property variation in the sheet width direction.

An object of the present invention to provide a hot-rolled steel sheet having excellent properties mentioned above (strength, ductility, and stretch flangeability) while satisfying low temperature toughness which is a general property required for a steel sheet to be applied to a vehicle component and the like.

Means for Solving the Problem

In view of the above-mentioned problems, as a result of intensive investigations on the chemical composition of a hot-rolled steel sheet and the relationship between the metallographic structure and the mechanical properties, the present inventors have obtained the following findings (a) to (g) and thus completed the present invention.

(a) In order to obtain excellent maximum tensile strength (hereinafter, sometimes referred to as strength or tensile strength), it is preferable that the metallographic structure is hard, and in order to obtain excellent stretch flangeability, it is preferable that the metallographic structure is homogeneous. Therefore, in order for the hot-rolled steel sheet to have both high strength and excellent stretch flangeability, bainite and tempered martensite, which have a hard and homogeneous structure, are suitable, and it is important to have a metallographic structure having bainite and tempered martensite as primary phases and having a small area fraction of ferrite, pearlite, and martensite.

(b) However, since bainite and tempered martensite are structures having poor ductility, excellent ductility cannot be secured simply with the metallographic structure having bainite and tempered martensite as primary phases.

(c) In order for the hot-rolled steel sheet to also have excellent ductility, it is effective to contain an appropriate amount of residual austenite that can enhance the ductility by transformation-induced plasticity (TRIP).

(d) In order to stabilize residual austenite at room temperature, it is effective to concentrate C diffused from bainite and tempered martensite during coiling into austenite. Therefore, it is effective to secure the incubation time in a specific temperature range after the transformation of bainite and tempered martensite is stopped. However, when this incubation time becomes too long, the austenite is decomposed and the amount of residual austenite is reduced. Thus, it is important to set an appropriate incubation time.

(e) In a case where the coil is coiled, the cooling rate differs greatly between a center portion in the sheet width direction and a position on the end surface side in the sheet width direction, and there is a difference in the incubation time after the martensitic transformation is stopped. Thus, the area fraction of the residual austenite changes, which causes material property variation in the sheet width direction. The material property variation in the sheet width direction means a difference between the balance (TS×EL) between tensile strength and ductility at the center portion in the sheet width direction and the balance (TS×EL) between tensile strength and ductility at the position on the end surface side in the sheet width direction (the position separated from the center portion to the end surface side by a predetermined distance).

(f) Since the time from the incubation of martensitic transformation to the start of decomposition of austenite (transformation incubation time) is significantly increased by containing Nb in the steel sheet, it is possible to reduce material property variation at the center position in the sheet width direction and the position on the end surface side in the sheet width direction when the cooling rate at the center portion of the hot-rolled steel sheet in the sheet width direction and at the endmost portion of the hot-rolled steel sheet in the sheet width direction in a case where the coil is coiled is controlled to be within a certain range.

(g) While ductility can be enhanced by transformation-induced plasticity (TRIP), the residual austenite is transformed into hard martensite by transformation-induced plasticity (TRIP) to reduce toughness. In a case where the primary phase is martensite, it is not possible to obtain minimum low temperature toughness required for a steel sheet for a suspension component for a vehicle. However, low temperature toughness can be secured by refining the average grain size of the metallographic structure and precipitating an appropriate amount of iron-based carbides to reduce the amount of solute C in the primary phase as bainite or tempered martensite.

The gist of the present invention made based on the above findings is as follows.

(1) A hot-rolled steel sheet according to an aspect of the present invention includes, as a chemical composition, by mass %, C: 0.100% to 0.250%;
Si: 0.05% to 3.00%;
Mn: 1.00% to 4.00%;
Nb: 0.005% to 0.050%;
sol. Al: 0.001% to 2.000%;
P: 0.100% or less;
S: 0.0300% or less;
N: 0.1000% or less;
O: 0.0100% or less;
Ti: 0% to 0.300%;
V: 0% to 0.500%;
Cu: 0% to 2.00%;
Cr: 0% to 2.00%;
Mo: 0% to 1.000%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;

one or two or more of Zr, Co, Zn, and W: 0% to 1.00% in total;

Sn: 0% to 0.050%; and a remainder including Fe and impurities, in which a metallographic structure at a sheet thickness ¼ depth from a surface and at a center position in a sheet width direction in a sheet width cross section parallel to a rolling direction contains, by area %, 77.0% to 97.0% of bainite and tempered martensite in total, 0% to 5.0% of ferrite, 0% to 5.0% of pearlite, 3.0% or more of residual austenite, and 0% to 10.0% of martensite, the average grain size of the metallographic structure excluding the residual austenite is 7.0 μm or less, the C concentration in the residual austenite is 0.5 mass % or more, and the number density of iron-based carbides having a diameter of 20 nm or more is $1.0\times10^6$ carbides/$mm^2$ or more.

(2) The hot-rolled steel sheet according to (1), in which in a case where area fractions of residual austenite in metallographic structures, the sheet width cross section parallel to the rolling direction, at the sheet thickness ¼ depth from the surface and at the center position in the sheet width direction, at the sheet thickness ¼ depth from the surface and at a position 300 mm from the center position in the sheet width direction to one end side in the sheet width direction, at the sheet thickness ¼ depth from the surface and at a position 600 mm from the center position in the sheet width direction to the one end side in the sheet width direction, at the sheet thickness ¼ depth from the surface and at a position 300 mm from the center position in the sheet width direction to the other end side in the sheet width direction, and at the sheet thickness ¼ depth from the surface and at a position 600 mm from the center position in the sheet width direction to the other end side are respectively denoted by $\gamma$, $\gamma_{D1}$, $\gamma_{D2}$, $\gamma_{W1}$, and $\gamma_{W2}$ in terms of area %, $\gamma/\gamma_{D1}$, $\gamma/\gamma_{D2}$, $\gamma/\gamma_{W1}$, and $\gamma/\gamma_{W2}$ may be each 0.8 or more and less than 1.2, and in a case where C concentrations in the residual austenite in the metallographic structures at the sheet thickness ¼ depth from the surface and at the center position in the sheet width direction, at the sheet thickness ¼ depth from the surface and at the position 300 mm from the center position in the sheet width direction to the one end side in the sheet width direction, at the sheet thickness ¼ depth from the surface and at the position 600 mm from the center position in the sheet width direction to the one end side in the sheet width direction, at the sheet thickness ¼ depth from the surface and at the position 300 mm from the center position in the sheet width direction to the other end side in the sheet width direction, and at the sheet thickness ¼ depth from the surface and at the position 600 mm from the center position in the sheet width direction to the other end side in the sheet width direction are respectively denoted by $C\gamma_C$, $C\gamma_{D1}$, $C\gamma_{D2}$, $C\gamma_{W1}$, and $C\gamma_{W2}$ in terms of mass %, $C\gamma_C/C\gamma_{D1}$, $C\gamma_C/C\gamma_{D2}$, $C\gamma_C/C\gamma_{W1}$, and $C\gamma_C/C\gamma_{W2}$ may be each 0.8 or more and less than 1.2.

(3) The hot-rolled steel sheet according to (1) or (2) may include, as the chemical composition, by mass %, one or two or more selected from the group consisting of Ti: 0.005% to 0.300%, V: 0.005% to 0.500%, Cu: 0.01% to 2.00%, Cr: 0.01% to 2.00%, Mo: 0.010% to 1.000%, Ni: 0.02% to 2.00%, B: 0.0001% to 0.0100%, Ca: 0.0005% to 0.0200%, Mg: 0.0005% to 0.0200%, REM: 0.0005% to 0.1000%, and Bi: 0.0005% to 0.020%.

Effects of the Invention

According to the above aspect of the present invention, it is possible to provide a hot-rolled steel sheet having excellent strength, ductility, stretch flangeability and low temperature toughness. Further, according to a preferable aspect of the present invention, it is possible to provide a hot-rolled steel sheet having the above-mentioned various properties and having a material property variation in the sheet width direction.

The hot-rolled steel sheet according to the above aspect of the present invention is suitable as an industrial material used for vehicle members, mechanical structural members, and building members.

EMBODIMENTS OF THE INVENTION

The chemical composition and metallographic structure of a hot-rolled steel sheet (hereinafter, sometimes simply referred to as a steel sheet) according to an embodiment will be described in detail below. However, the present invention is not limited to the configuration disclosed in the embodiment, and various modifications can be made without departing from the spirit of the present invention.

The numerical limit range described below includes the lower limit and the upper limit. Regarding the numerical value indicated by "less than" or "more than", the value does not fall within the numerical range. In the following description, % regarding the chemical composition of the steel sheet is mass % unless otherwise specified.

1. Chemical Composition

The hot-rolled steel sheet according to the embodiment includes, by mass %, C: 0.100% to 0.250%, Si: 0.05% to 3.00%, Mn: 1.00% to 4.00%, Nb: 0.005% to 0.050%, sol. Al: 0.001% to 2.000%, P: 0.100% or less, S: 0.0300% or less, N: 0.1000% or less, O: 0.0100% or less, and a remainder including Fe and impurities. Each element will be described in detail below.

(1-1) C: 0.100% to 0.250%

C has an effect of promoting the formation of bainite and also has an effect of stabilizing residual austenite. When the C content is less than 0.100%, it is difficult to obtain the desired bainite area fraction and the desired residual austenite area fraction. When the desired bainite area fraction cannot be obtained, it may be difficult to obtain the desired area fraction of bainite and tempered martensite. Therefore, the C content is set to 0.100% or more. The C content is preferably 0.120% or more or 0.150% or more. On the other hand, when the C content is more than 0.250%, pearlite is preferentially formed to insufficiently form bainite and residual austenite, and thus it is difficult to obtain the desired bainite area fraction and the desired residual austenite area fraction. Therefore, the C content is set to 0.250% or less. The C content is preferably 0.220% or less.

(1-2) Si: 0.05 to 3.00%

Si has an effect of delaying the precipitation of cementite. By this effect, the amount of austenite remaining in an untransformed state, that is, the area fraction of the residual austenite can be enhanced, and the strength of the steel sheet can be enhanced by solid solution strengthening. In addition, Si has an effect of making the steel sound by deoxidation (suppressing the occurrence of defects such as blow holes in the steel). When the Si content is less than 0.05%, the effect cannot be obtained. Therefore, the Si content is set to 0.05% or more. The Si content is preferably 0.50% or more or 1.00% or more. However, when the Si content is more than 3.00%, the surface properties, the chemical convertibility, the ductility and the weldability of the steel sheet are remarkably deteriorated, and the $A_3$ transformation point is remarkably increased. This makes it difficult to perform hot rolling in a stable manner. Therefore, the Si content is set to 3.00% or less. The Si content is preferably 2.70% or less or 2.50% or less.

(1-3) Mn: 1.00% to 4.00%

Mn has an effect of suppressing ferritic transformation to promote the formation of bainite. When the Mn content is less than 1.00%, the desired area fraction of bainite cannot be obtained. Therefore, the Mn content is set to 1.00% or more. The Mn content is preferably 1.50% or more and more preferably 1.80% or more. On the other hand, when the Mn content is more than 4.00%, the completion of the bainitic transformation is delayed, the carbon concentration to austenite is not promoted, and residual austenite is insufficiently formed. Thus, it is difficult to obtain the desired area fraction of residual austenite. Further, it is difficult to increase the C concentration in the residual austenite. Therefore, the Mn content is set to 4.00% or less. The Mn content is preferably 3.70% or less or 3.50% or less.

(1-4) Nb: 0.005% to 0.050%

In the embodiment, Nb is an important element. Nb is usually contained in the steel for the purpose of precipitation hardening of ferrite using carbides and for the purpose of refining the austenite grain size by controlled rolling. In addition to these effects, the present inventors have newly found that Nb has an effect of significantly increasing the time from the transformation incubation of bainite and tempered martensite to the start of decomposition of austenite (transformation incubation time). Since the transformation incubation time is increased, it becomes difficult for austenite to decompose into cementite and martensite after a coiling treatment, and even when a difference in cooling rate in the sheet width direction of the hot-rolled steel sheet is large, the area fraction of the residual austenite can be kept constant. That is, in a case where the coil is coiled, when the average cooling rate in the center portion of the hot-rolled steel sheet having a relatively slow cooling rate in the sheet width direction and the endmost portion of the hot-rolled steel sheet having a relatively fast cooling rate in the sheet width direction is controlled to be within a predetermined range, the material property variation can be reduced.

The mechanism of increasing the transformation incubation time by Nb is not clear, but it is considered that in a case where the residual austenite is decomposed to form ferrite, Nb carbides are precipitated and further growth of ferrite is delayed. Since the above effect is exhibited when the Nb content is 0.005% or more, the Nb content is set to 0.005% or more. The Nb content is preferably 0.010% or more or 0.015% or more. On the other hand, when the Nb content is more than 0.050%, an effect of increasing the transformation incubation time is saturated, recrystallization of austenite during rolling is suppressed, and bainite or tempered martensite and residual austenite are formed in layers. Thus, the stretch flangeability of the steel sheet is decreased. Therefore, the Nb content is set to 0.050% or less. The Nb content is preferably 0.040% or less or 0.030% or less.

(1-5) sol. Al: 0.001% to 2.000%

Similar to Si, Al has an effect of deoxidizing the steel to make the steel sheet sound, and also has an effect of promoting the formation of residual austenite by suppressing the precipitation of cementite from austenite. When the sol. Al content is less than 0.001%, the above effects cannot be obtained. Therefore, the sol. Al content is set to 0.001% or more. The sol. Al content is preferably 0.010% or more. On the other hand, when the sol. Al content is more than 2.000%, the above effects are saturated and this case is not economically preferable. Thus, the sol. Al content is set to 2.000% or less. The sol. Al content is preferably 1.500% or less or 1.300% or less. In addition, sol. Al is an abbreviation for soluble Al.

(1-6) P: 0.100% or less

P is an element that is generally contained as an impurity and is also an element having an effect of enhancing the strength by solid solution strengthening. Therefore, although P may be positively contained, P is an element that is easily segregated, and when the P content is more than 0.100%, the formability and toughness are significantly decreased due to the grain boundary segregation. Therefore, the P content is limited to 0.100% or less. The P content is preferably 0.030% or less. The lower limit of the P content does not need to be particularly specified, but is preferably 0.001% from the viewpoint of refining cost.

(1-7) S: 0.0300% or less

S is an element that is contained as an impurity and forms sulfide-based inclusions in the steel to decrease the formability of the hot-rolled steel sheet. When the S content is more than 0.0300%, the formability of the steel sheet is significantly decreased. Therefore, the S content is limited to 0.0300% or less. The S content is preferably 0.0050% or less. The lower limit of the S content does not need to be particularly specified, but is preferably 0.0001% from the viewpoint of refining cost.

(1-8) N: 0.1000% or less

N is an element contained in steel as an impurity and has an effect of decreasing the formability of the steel sheet. When the N content is more than 0.1000%, the formability of the steel sheet is significantly decreased. Therefore, the N content is set to 0.1000% or less. The N content is preferably 0.0800% or less and more preferably 0.0700% or less. Although the lower limit of the N content does not need to be particularly specified, as will be described later, in a case where one or two or more of Ti and V are contained to refine the metallographic structure, the N content is preferably 0.0010% or more and more preferably 0.0020% or more to promote the precipitation of carbonitride.

(1-9) O: 0.0100% or less

When a large amount of O is contained in the steel, O forms a coarse oxide that becomes the origin of fracture, and causes brittle fracture and hydrogen-induced cracks. Therefore, the O content is limited to 0.0100% or less. The O content is preferably 0.0080% or less and 0.0050% or less. The O content may be 0.0005% or more or 0.0010% or more to disperse a large number of fine oxides when the molten steel is deoxidized.

The remainder of the chemical composition of the hot-rolled steel sheet according to the embodiment includes Fe and impurities. In the embodiment, the impurities mean those mixed from ore as a raw material, scrap, manufacturing environment, and the like, and are allowed within a range that does not adversely affect the hot-rolled steel sheet according to the embodiment.

In addition to the above elements, the hot-rolled steel sheet according to the embodiment may contain Ti, V, Cu, Cr, Mo, Ni, B, Ca, Mg, REM, Bi, Zr, Co, Zn, W, and Sn as optional elements. In a case where the above optional elements are not contained, the lower limit of the content thereof is 0%. Hereinafter, the above optional elements will be described in detail.

(1-10) Ti: 0.005% to 0.300% and V: 0.005% to 0.500%

Since both Ti and V are precipitated as carbides or nitrides in the steel and have an effect of refining the metallographic structure by an austenite pinning effect, these elements may be contained as necessary. In order to more reliably obtain the effect, it is preferable that the Ti content is set to 0.005% or more, or the V content is set to 0.005% or more. However, even when these elements are excessively contained, the effect is saturated, and this case is not economically preferable. Therefore, the Ti content is set to 0.300% or less, and the V content is set to 0.500% or less.

(1-11) Cu: 0.01% to 2.00%, Cr: 0.01% to 2.00%, Mo: 0.010% to 1.000%, Ni: 0.02% to 2.00% and B: 0.0001% to 0.0100%

All of Cu, Cr, Mo, Ni, and B have an effect of enhancing the hardenability of the steel sheet. In addition, Cr and Ni have an effect of stabilizing residual austenite, and Cu and Mo have an effect of precipitating carbides in the steel to increase the strength. Further, in a case where Cu is contained, Ni has an effect of effectively suppressing the grain boundary crack of the slab caused by Cu. Therefore, these elements may be contained as necessary.

Cu has an effect of enhancing the hardenability of the steel sheet and an effect of precipitating as carbide in the steel at a low temperature to enhance the strength of the steel sheet. In order to more reliably obtain the effect, the Cu content is preferably 0.01% or more and more preferably 0.05% or more. However, when the Cu content is more than 2.00%, grain boundary cracks may occur in the slab in some cases. Therefore, the Cu content is set to 2.00% or less. The Cu content is preferably 1.50% or less and 1.00% or less.

As described above, Cr has an effect of enhancing the hardenability of the steel sheet and an effect of stabilizing residual austenite. In order to more reliably obtain the effect, the Cr content is preferably 0.01% or more or 0.05% or more. However, when the Cr content is more than 2.00%, the chemical convertibility of the steel sheet is significantly decreased. Accordingly, the Cr content is set to 2.00% or less.

As described above, Mo has an effect of enhancing the hardenability of the steel sheet and an effect of precipitating carbides in the steel to enhance the strength. In order to more reliably obtain the effect, the Mo content is preferably 0.010% or more or 0.020% or more. However, even when the Mo content is more than 1.000%, the effect is saturated, and this case is not economically preferable. Therefore, the Mo content is set to 1.000% or less. The Mo content is preferably 0.500% or less and 0.200% or less.

As described above, Ni has an effect of enhancing the hardenability of the steel sheet. In addition, when Cu is contained, Ni has an effect of effectively suppressing the grain boundary crack of the slab caused by Cu. In order to more reliably obtain the effect, the Ni content is preferably 0.02% or more. Since Ni is an expensive element, it is not economically preferable to contain a large amount of Ni. Therefore, the Ni content is set to 2.00% or less.

As described above, B has an effect of enhancing the hardenability of the steel sheet. In order to more reliably obtain the effect, the B content is preferably 0.0001% or more or 0.0002% or more. However, when the B content is more than 0.0100%, the formability of the steel sheet is significantly decreased, and thus the B content is set to 0.0100% or less. The B content is preferably 0.0050% or less.

(1-12) Ca: 0.0005% to 0.0200%, Mg: 0.0005% to 0.0200%, REM: 0.0005% to 0.1000% and Bi: 0.0005% to 0.020%

All of Ca, Mg, and REM have an effect of enhancing the formability of the steel sheet by adjusting the shape of inclusions to a preferable shape. In addition, Bi has an effect of enhancing the formability of the steel sheet by refining the solidification structure. Therefore, these elements may be contained as necessary. In order to more reliably obtain the effect, it is preferable that any one or more of Ca, Mg, REM, and Bi is 0.0005% or more. However, when the Ca content or Mg content is more than 0.0200%, or when the REM content is more than 0.1000%, the inclusions are excessively formed in the steel, and thus the formability of the steel sheet may be decreased in some cases. In addition, even when the Bi content is more than 0.020%, the above effect is saturated, and this case is not economically preferable. Therefore, the Ca content and Mg content are set to 0.0200% or less, the REM content is set to 0.1000% or less, and the Bi content is set to 0.020% or less. The Bi content is preferably 0.010% or less.

Here, REM refers to a total of 17 elements made up of Sc, Y and lanthanoid, and the REM content refers to the total content of these elements. In the case of lanthanoid, lanthanoid is industrially added in the form of misch metal.

(1-13) One or Two or More of Zr, Co, Zn and W: 0% to 1.00% in total and Sn: 0% to 0.050%

Regarding Zr, Co, Zn, and W, the present inventors have confirmed that even when the total content of these elements is 1.00% or less, the effect of the hot-rolled steel sheet according to the embodiment is not impaired. Therefore, one or two or more of Zr, Co, Zn, and W may be contained in a total of 1.00% or less.

In addition, the present inventors have confirmed that the effects of the hot-rolled steel sheet according to the embodiment am not impaired even when a small amount of Sn is contained, but flaws may be generated at the time of hot rolling. Thus, the Sn content is set to 0.050% or less.

2. Metallographic Structure of Hot-Rolled Steel Sheet

Next, the metallographic structure of the hot-rolled steel sheet according to the embodiment will be described.

In the hot-rolled steel sheet according to the embodiment, since a metallographic structure at a sheet thickness ¼ depth from the surface and at a center position in a sheet width direction in a sheet width cross section parallel to the rolling direction contains, by area fraction (area %), 77.0% to 97.0% of bainite and tempered martensite in total, 0% to 5.0% of ferrite, 0% to 5.0% of pearlite, 3.0% or more of residual austenite, and 0% to 10.0% of martensite, a maximum tensile strength of 980 MPa or more and high press formability (ductility and stretch flangeability) can be obtained. In the embodiment, the reason for defining the metallographic structure at the sheet thickness ¼ depth from the surface and the center position in the sheet width direction in the sheet width cross section parallel to the rolling direction is that the metallographic structure at this position is a typical metallographic structure of the steel sheet. Here, the sheet width cross section parallel to the rolling direction refers to a cross section (so-called L cross section) which is parallel to the rolling direction and the sheet thickness direction and is vertical to the sheet width direction.

(2-1) Total Area Fraction of Bainite and Tempered Martensite: 77.0% to 97.0%

Bainite and tempered martensite are the most important metallographic structures in this embodiment.

Bainite is an aggregation of lath-shaped crystal grains. The bainite includes upper bainite which includes carbides between laths and is an aggregation of laths, and lower bainite which includes iron-based carbides having a major axis of 5 nm or more inside thereof. The iron-based carbides precipitated in the lower bainite belong to a single variant, that is, an iron-based carbide group extending in the same direction. The tempered martensite is an aggregation of lath-shaped crystal grains and contains iron-based carbides having a major axis of 5 nm or more inside thereof. The iron-based carbides in the tempered martensite belong to a plurality of variants, that is, a plurality of iron-based carbide groups extending in different directions.

As described above, bainite and tempered martensite are hard and homogeneous metallographic structures, which are suitable metallographic structures for steel sheets to have both high strength and excellent stretch flangeability. When the total area fraction of the bainite and the tempered martensite is less than 77.0%, the steel sheet cannot have both high strength and excellent stretch flangeability. Therefore, the total area fraction of the bainite and the tempered martensite is 77.0% or more. The total area fraction of the bainite and the tempered martensite is preferably 85.0% or more and more preferably 90.0% or more. Since the hot-rolled steel sheet according to the embodiment contains 3.0% or more of residual austenite, the total area fraction of bainite and tempered martensite is 97.0% or less.

(2-2) Area Fraction of Ferrite: 0% to 5.0%

The ferrite is a massive crystal grain and means a metallographic structure in which a substructure such as lath is not contained inside thereof. When the area fraction of soft ferrite is more than 5.0%, the interface between ferrite and bainite or tempered martensite, and the interface between ferrite and residual austenite, which are likely to be starting points of void initiation, are increased. Thus, particularly, the stretch flangeability of the steel sheet is decreased. Therefore, the area fraction of the ferrite is set to 5.0% or less. The area fraction of the ferrite is preferably 4.0% or less, 3.0% or less, or less than 2.0%. It is preferable to reduce the area fraction of the ferrite as much as possible to improve the stretch flangeability of the steel sheet, and the lower limit thereof is 0%.

(2-3) Area Fraction of Pearlite: 0% to 5.0%

The pearlite has a lamellar metallographic structure in which cementite is precipitated in layers between the ferrite grains, and is a soft metallographic structure compared to the bainite. When the area fraction of the pearlite is more than 5.0%, the interface between the pearlite and the bainite or tempered martensite and the interface between the pearlite and the residual austenite, which are likely to be starting points of void initiation, are increased. Thus, particularly, the stretch flangeability of the steel sheet is decreased. Therefore, the area fraction of the pearlite is set to 5.0% or less. The area fraction of the pearlite is preferably 4.0% or less, 3.0% or less, or 2.0% or less. It is preferable to reduce the area fraction of the pearlite as much as possible to improve the stretch flangeability of the steel sheet, and the lower limit thereof is 0%.

(2-4) Area Fraction of Martensite: 0% to 10.0%

In the embodiment, the martensite is defined as a metallographic structure in which carbides having a diameter of 5 nm or more are not precipitated between the laths and inside the laths. The martensite (so-called fresh martensite) is a very hard structure and greatly contributes to an increase in the strength of steel sheet. On the other hand, when the martensite is contained in the metallographic structure, the interface between the martensite and the primary phases of the bainite and the tempered martensite becomes a starting point of void initiation, and the stretch flangeability of the steel sheet is particularly decreased. Further, since the martensite has a hard structure, the low temperature toughness of the steel sheet is deteriorated. Therefore, the area fraction of the martensite is set to 10.0% or less. The area fraction of the martensite is preferably 8% or less, 6% or less, or 3% or less. Since the hot-rolled steel sheet according to the embodiment includes a predetermined amount of bainite and tempered martensite, it is possible to secure the desired strength even in a case where the martensite is not contained. In order to obtain the desired stretch flangeability, the area fraction of the martensite is preferably reduced as much as possible, and the lower limit thereof is 0%.

The identification of metallographic structures of bainite, tempered martensite, ferrite, pearlite, and martensite, which constitute the metallographic structure of the hot-rolled steel sheet according to the embodiment as described above, and the confirmation of the presence positions, and the measurement of the area fraction are performed by the following methods.

First, a Nital reagent and the reagent disclosed in Japanese Unexamined Patent Application, First Publication No. S59-219473 are used to corrode a sheet width cross section parallel to the rolling direction. Regarding the corrosion of the sheet width cross section, specifically, a solution prepared by dissolving 1 to 5 g of picric acid in 100 ml of ethanol is used as solution A, and a solution prepared by dissolving 1 to 25 g of sodium thiosulfate and 1 to 5 g of citric acid in 100 ml of water is used as a solution B. A liquid mixture in which the solution A and the solution B are mixed at a ratio of 1:1 is prepared and a liquid prepared by adding and mixing nitric acid at a ratio of 1.5 to 4% with respect to the total amount of the liquid mixture is used as a pretreatment liquid. In addition, a liquid prepared by adding and mixing the pretreatment liquid in a 2% Nital solution at a ratio of 10% with respect to the total amount of the 2% Nital solution is used as a post treatment liquid. The sheet width cross section parallel to the rolling direction is immersed in the pretreatment liquid for 3 to 15 seconds, washed with alcohol, and dried. Then, the cross section is immersed in the post treatment liquid for 3 to 20 seconds, then washed with water, and dried to corrode the sheet width cross section. In addition, % regarding the reagent is volume %, and the ratio is the volume ratio.

Next, the identification of the metallographic structures, the confirmation of the presence positions, and the measurement of the area fractions are performed by observing at least three regions having a size of 40 μm×30 μm at a magnification of 1000 to 100000 times using a scanning electron microscope at a sheet thickness ¼ depth from the surface of the steel sheet and at the center position in the sheet width direction. Since it is difficult to distinguish between lower bainite and tempered martensite by the measurement method described above, it is not necessary to distinguish between the lower bainite and the tempered martensite in the embodiment. That is, the total area fraction of "bainite and tempered martensite" is obtained by measuring the area fractions of "upper bainite" and "lower bainite or tempered martensite". As described above, the upper bainite is an aggregation of laths and is a structure containing carbides between the laths. The lower bainite is a structure containing iron-based carbides having a major axis of 5 nm or more and extending in the same direction therein. The tempered martensite is an aggregation of lath-shaped crystal grains and is a structure containing iron-based carbides having a major axis of 5 nm or more and extending in the different directions therein.

(2-5) Area Fraction of Residual Austenite: 3.0% or More

The residual austenite is a metallographic structure that is present as a face-centered cubic lattice even at room temperature. The residual austenite has an effect of increasing the ductility of the steel sheet due to transformation-induced plasticity (TRIP). When the area fraction of the residual austenite is less than 3.0%, the effect cannot be obtained and the ductility of the steel sheet is deteriorated. Therefore, the area fraction of the residual austenite is set to 3.0% or more. The area fraction of the residual austenite is preferably 5.0% or more, more preferably 7.0% or more, and even more preferably 8.0% or more. The upper limit of the area fraction of the residual austenite does not need to be particularly specified, but since the area fraction of the residual austenite that can be secured in the chemical composition of the hot-rolled steel sheet according to the embodiment is approximately 20.0%, the upper limit of the area fraction of the residual austenite may be set to 20.0%.

As the measurement method of the area fraction of the residual austenite, methods by X-ray diffraction, electron back scatter diffraction image (EBSP, electron back scattering diffraction pattern) analysis, and magnetic measurement and the like may be used and the measured values may differ depending on the measurement method. In this embodiment, the area fraction of the residual austenite is measured by X-ray diffraction.

In the measurement of the area fraction of the residual austenite by X-ray diffraction in the embodiment, first, the integrated intensities of a total of 6 peaks of $\alpha(110)$, $\alpha(200)$, $\alpha(211)$, $\gamma(111)$, $\gamma(200)$, and $\gamma(220)$ are obtained in the sheet width cross section parallel to the rolling direction at a sheet thickness ¼ depth position using Co-K$\alpha$ rays, and the area fraction of the residual austenite is obtained by calculation using the intensity averaging method.

In the embodiment, the area fraction of the bainite, tempered martensite, ferrite, pearlite and martensite (the area fraction excluding the residual austenite) and the area fraction of the residual austenite are measured by different measurement methods. Thus, the total of the two area fractions may not be 100.0%. In a case where the total of the area fraction other than the residual austenite and the area fraction of the residual austenite is not 100.0%, the above two area fractions are adjusted so that the total becomes 100.0%. For example, in a case where the total of the area fraction excluding the residual austenite and the area fraction of the residual austenite is 101.0%, in order to make the total of the two area fractions 100.0%, a obtained by multiplying the area fraction excluding the residual austenite obtained by the measurement by 100.0/101.0 is defined as the area fraction excluding the residual austenite, and a value obtained by multiplying the area fraction of the residual austenite obtained by measurement by 100.0/101.0 is defined as the area fraction of the residual austenite.

In a case where the total of the area fraction excluding the residual austenite and the area fraction of the residual austenite is less than 95.0% or more than 105.0%, the area fractions are measured again.

(2-6) Average Grain Size of Metallographic Structure Excluding Residual Austenite: 7.0 μm or Less The average grain size (hereinafter, simply referred to as the average grain size in some cases) of the metallographic structure (bainite and tempered martensite as primary phases, ferrite, pearlite, and martensite) excluding the residual austenite is refined and thus the low temperature toughness of the steel sheet is improved. When the average grain size is more than 7.0 μm, vTrs≤−50° C., which is an index of low temperature toughness required for steel sheets for suspension components of vehicles, cannot be satisfied. Therefore, the average grain size is set to 7.0 μm or less. It is not necessary to particularly limit the lower limit of the average grain size. The smaller the average grain size is, the more preferable it is. However, since it may be practically difficult to set the average grain size to less than 1.0 μm from the viewpoint of manufacturing equipment, the average grain size may be 1.0 μm or more.

In the embodiment, the crystal grains are defined by using the electron back scatter diffraction pattern-orientation image microscope (EBSP-OIM) method. In the EBSP-OIMTM method, a crystal orientation of an irradiation point can be measured for a short time period in such manner that a highly inclined sample in a scanning electron microscope (SEM) is irradiated with electron beams, a Kikuchi pattern formed by back scattering is photographed by a high sensitive camera, and the photographed image is processed by a computer. The EBSP-OIM method is performed using a device in which a scanning electron microscope and an EBSP analyzer are combined and an OIM Analysis (registered trademark) manufactured by AMETEK Inc. In the EBSP-OIM method, the fine structure and crystal orientation of the sample surface can be quantitatively analyzed. The analyzable area of the EBSP-OIM method is a region that can be observed by the SEM. The EBSP-OIM method makes it possible to analyze a region with a minimum resolution of 20 nm, which varies depending on the resolution of the SEM, Since the threshold value of the high-angle grain boundary generally recognized as a grain boundary is 15°, in the embodiment, from a mapping image in which a crystal grain with an orientation difference of adjacent crystal grains of 15° or more is defined as one crystal grain, crystal grains are visualized, from which the average grain size of the area average calculated by the OIM Analysis is obtained.

When measuring the average grain size of the metallographic structure at the sheet thickness ¼ depth from the surface of the steel sheet and at the center position in the sheet width direction in the sheet width cross section parallel to the rolling direction, the effective grain size grain size of the crystal grain is measured in at least 10 visual fields of a region of 40 μm×30 μm at a magnification of 1200 times, and the average of the effective grain sizes is used as the average grain size. In this measurement method, since the area fraction of structures other than the primary phases is small, it is determined that the effect is small, and the average grain size of the bainite and the tempered martensite, which are the primary phases, and the average grain size of the ferrite, the pearlite, and the martensite are not distinguished. That is, the average grain sizes measured by the above-mentioned measurement method are the average grain sizes of the bainite, the tempered martensite, the ferrite, the pearlite, and the martensite. In the measurement of the effective grain size of the pearlite, the effective grain size of the ferrite in the pearlite is measured instead of the effective grain size of the pearlite block.

(2-7) C Concentration in Residual Austenite: 0.5 Mass % or More

By setting the C concentration (carbon concentration) in the residual austenite to 0.5 mass % or more, the residual austenite is moderately stabilized, and transformation-induced plasticity (TRIP) is generated in a high strain region in the late stage of deformation. Thus, the ductility and stretch flangeability of the steel sheet can be improved. Therefore, the C concentration in the residual austenite is set to 0.5 mass % or more. The C concentration in the residual austenite is more preferably 0.7 mass % or more. In addition, by setting the C concentration in the residual austenite to 2.0 mass % or less, excessive stabilization of the residual austenite is suppressed, and thus transformation-induced plasticity (TRIP) can be more reliably exhibited. Therefore, the C concentration in the residual austenite is preferably 2.0 mass % or less.

The C concentration in the residual austenite is obtained by X-ray diffraction. Specifically, in the metallographic structure at the sheet thickness ¼ depth from the surface of the steel sheet and at the center position in the sheet width direction in the sheet width cross section parallel to the rolling direction, X-ray analysis with Cu-Kα rays is performed, and a lattice constant a (unit: angstrom) is obtained from reflection angles of the (200), (220) and (311) planes of the residual austenite to calculate the C concentration (Cγ) in the residual austenite according to Expression (1).

$$C\gamma=(a-3.572)/0.033 \quad (1)$$

(2-8) Number Density of Iron-Based Carbides Having Diameter of 20 nm or More: $1.0\times10^6$ Carbides/mm$^2$ or More The reason why iron-based carbides having a diameter of 20 nm or more are contained in the steel at a density of $1.0\times10^6$ carbides/mm$^2$ or more is to enhance the low temperature toughness of the primary phase and to obtain a balance between excellent strength and low temperature toughness.

In a case where the primary phase of the steel sheet is as-quenched martensite, the strength is excellent but the low temperature toughness is poor. Thus, it is necessary to improve the low temperature toughness. Therefore, by precipitating a predetermined number or more of iron-based carbides in the steel, the low temperature toughness of the primary phase is improved, and the low temperature toughness (vTrs≤−50° C.) required for steel sheets for suspension components of vehicles is achieved. The iron-based carbide in the embodiment means one having a major axis length of less than 1 μm. That is, coarse carbides precipitated between cementite and bainite lath in pearlite having a major axis length of 1 μm or more are not included in the iron-based carbides.

As a result of investigating the relationship between low temperature toughness of the hot-rolled steel sheet and the number density of the iron-based carbides, the present inventors have found that by setting the number density of the iron-based carbides to $1.0\times10^6$ (carbides/mm$^2$) or more, more excellent low temperature toughness can be obtained. Therefore, in the embodiment, the number density of iron-based carbides is set to $1.0\times10^6$ carbides/mm$^2$ or more in the metallographic structure at the sheet thickness ¼ depth from the surface of the steel sheet and at the center position in the sheet width direction in the sheet width cross section parallel to the rolling direction. The number density of iron-based carbides is preferably $5.0\times10^6$ carbides/mm$^2$ or more and more preferably $1.0\times10^7$ carbides/mm$^2$ or more. The number density of the iron-based carbides may be $1.0\times10^{10}$ carbides/mm$^2$ or less. This is because, when the number density of the iron-based carbides is more than $1.0\times10^{10}$ carbides/mm$^2$, carbon concentration does not occur in the residual austenite and the carbon concentration in the residual austenite may be decreased.

In addition, it is assumed that since the size of the iron-based carbides precipitated in the hot-rolled steel sheet according to the embodiment is as small as 300 nm or less, and most of the iron-based carbides are precipitated in the lath of martensite or bainite, the low temperature toughness of the steel sheet is not deteriorated.

The number density of iron-based carbides is measured by collecting a sample with the sheet width cross section parallel to the rolling direction as an observed section, polishing and nital-etching the observed section, and observing a range of ⅛ sheet thickness to ⅜ sheet thickness with a sheet thickness ¼ depth from the surface of the steel sheet and a center position in the sheet width direction being the center using a field emission scanning electron microscope (FE-SEM). Observation is performed at a magnification of 20000 times in 10 visual fields or more, the number density of iron-based carbides is measured, and the average is calculated to obtain the number density of the iron-based carbides.

(2-9) $\gamma/\gamma_{D1}$, $\gamma/\gamma_{D2}$, $\gamma/\gamma_{W1}$, and $\gamma/\gamma_{W2}$: 0.8 or More and Less Than 1.2, and $C\gamma_C/C\gamma_{D1}$, $C\gamma_C/C\gamma_{D2}$, $C\gamma_C/C\gamma_{W1}$, and $C\gamma_C/C\gamma_{W2}$: 0.8 or More and Less Than 1.2 In a case where, when the area fractions of the residual austenite in the metallographic structures, in the sheet width cross section parallel to the rolling direction, at the sheet thickness ¼ depth from the surface and at the center position in the sheet width direction, at the sheet thickness ¼ depth from the surface and at a position 300 mm from the center position in the sheet width direction to one end side in the sheet width direction, at the sheet thickness ¼ depth from the surface and at a position 600 mm from the center position in the sheet width direction to the one end side in the sheet width direction, at the sheet thickness ¼ depth from the surface and at a position 300 mm from the center position in the sheet width direction to the other end side in the sheet width direction, and at the sheet thickness ¼ depth from the surface and at a position 600 mm from the center position in the sheet width direction to the other end side in the sheet width direction are respectively denoted by $\gamma$, $\gamma_{D1}$, $\gamma_{D2}$, $\gamma_{W1}$, and $\gamma_{W2}$, $\gamma/\gamma_{D1}$, $\gamma/\gamma_{D2}$, $\gamma/\gamma_{W1}$, and $\gamma/\gamma_{W2}$ are each 0.8 or more and less than 1.2, and when the C concentrations in the residual austenite in the metallographic structures at the sheet thickness ¼ depth from the surface and at the center position in the sheet width direction, at the sheet thickness ¼ depth from the surface and at the position 300 mm from the center position in the sheet width direction to the one end side in the sheet width direction, at the sheet thickness ¼ depth from the surface and at the position 600 mm from the center position in the sheet width direction to the one end side in the sheet width direction, at the sheet thickness ¼ depth from the surface and at the position 300 mm from the center position in the sheet width direction to the other end side in the sheet width direction, and at the sheet thickness ¼ depth from the surface and at the position 600 mm from the center position in the sheet width direction to the other end side in the sheet width direction are respectively denoted by $C\gamma_C$, $C\gamma_{D1}$, $C\gamma_{D2}$, $C\gamma_{W1}$, and $C\gamma_{W2}$ in terms of mass %, $C\gamma_C/C\gamma_{D1}$, $C\gamma_C/C\gamma_{D2}$, $C\gamma_C/C\gamma_{W1}$, and $C\gamma_C/C\gamma_{W2}$ are each 0.8 or more and less than 1.2, it is possible to further reduce the material property variation between the center position in the sheet width direction and the position on the end surface side in the sheet width direction. In a case where the values of $\gamma/\gamma_{D1}$, $\gamma/\gamma_{D2}$, $\gamma/\gamma_{W1}$, and $\gamma/\gamma_{W2}$ do not satisfy the above conditions, the frequency of occurrence of the transformation-induced plasticity (TRIP) phenomenon differs depending on the sheet width direction. Thus, the variation in the strength and ductility of the product is great, which may cause a decrease in yield. Further, in a case where the values of $C\gamma_C/C\gamma_{D1}$, $C\gamma_C/C\gamma_{D2}$, $C\gamma_C/C\gamma_{W1}$, and $C\gamma_C/C\gamma_{W2}$ do not satisfy the above conditions, the stability of the residual austenite differs depending on the sheet width direction. Thus, the variation in the product of strength and ductility is great, which may cause a decrease in yield. In the embodiment, the other end side in the sheet width direction refers to the opposite side of the one end side in the sheet width direction.

In the sheet width cross section parallel to the rolling direction, the area fractions ($\gamma$, $\gamma_{D1}$, $\gamma_{D2}$, $\gamma_{W1}$, and $\gamma_{W2}$) of the residual austenite in the metallographic structures at the sheet thickness ¼ depth from the surface and at the center position in the sheet width direction, at the sheet thickness ¼ depth from the surface and at the position 300 mm from the center position in the sheet width direction to one end side in the sheet width direction, at the sheet thickness ¼ depth from the surface and at the position 600 mm from the center position in the sheet width direction to one end side in the sheet width direction, at the sheet thickness ¼ depth from the surface and at the position 300 mm from the center position in the sheet width direction to the other end side in the sheet width direction, and at the sheet thickness ¼ depth from the surface and at the position 600 mm from the center position in the sheet width direction to the other end side in the sheet width direction, and the C concentrations ($C\gamma_C$, $C\gamma_{D1}$, $C\gamma_{D2}$, $C\gamma_{W1}$, and $C\gamma_{W2}$) by mass % in the residual austenite in the metallographic structures at the respective positions are measured by a method of measuring the above-mentioned area fractions of the residual austenite and a method of measuring the C concentrations in the residual austenite at the respective positions.

3. Sheet Thickness

The thickness of the hot-rolled steel sheet according to the embodiment is not particularly limited and may be 1.2 to 8.0 mm. When the sheet thickness of the hot-rolled steel sheet is less than 1.2 mm, it may be difficult to secure the rolling completion temperature and the rolling force may become excessive, making hot rolling difficult. Therefore, the thickness of the hot-rolled steel sheet according to the present invention may be 1.2 mm or more. The sheet thickness is preferably 1.4 mm or more. On the other hand, when the sheet thickness is more than 8.0 mm, it may be difficult to refine the metallographic structure, and it may be difficult to secure the metallographic structure described above. Therefore, the sheet thickness may be 8.0 mm or less. The sheet thickness is preferably 6.0 mm or less.

4. Others (4-1) Plating Layer

The hot-rolled steel sheet according to the embodiment having the above-described chemical composition and metallographic structure may be a surface-treated steel sheet provided with a plating layer on the surface for the purpose of improving corrosion resistance and the like. The plating layer may be an electro plating layer or a hot-dip plating layer. Examples of the electro plating layer include electrogalvanizing and electro Zn—Ni alloy plating. Examples of the hot-dip plating layer include hot-dip galvanizing, hot-dip galvannealing, hot-dip aluminum plating, hot-dip Zn—Al alloy plating, hot-dip Zn—Al—Mg alloy plating, and hot-dip Zn—Al—Mg—Si alloy plating. The plating adhesion amount is not particularly limited and may be the same as before. Further, it is also possible to further enhance the corrosion resistance by applying an appropriate chemical conversion treatment (for example, application and drying of a silicate-based chromium-free chemical conversion treatment liquid) after plating.

5. Manufacturing Conditions

A suitable method for manufacturing the hot-rolled steel sheet according to the embodiment having the above-mentioned chemical composition and metallographic structure is as follows.

In order to obtain the hot-rolled steel sheet according to the embodiment, it is important that after hot-rolling is performed under predetermined conditions, the hot-rolled steel sheet is cooled to a predetermined temperature range and coiled, and then the cooling history at the endmost portion of the hot-rolled steel sheet in the sheet width direction and at the center portion of the hot-rolled steel sheet in the sheet width direction is controlled.

In the suitable method for manufacturing the hot-rolled steel sheet according to the embodiment, the following steps (1) to (7) are sequentially performed. The temperature of the slab and the temperature of the steel sheet in the embodiment refer to the surface temperature of the slab and the surface temperature of the steel sheet.

(1) A slab is heated to a temperature T1 (° C.) or higher represented by Expression (2).

(2) Hot rolling is performed in a temperature range of 850° C. to 1100° C. so that the total sheet thickness is reduced by 90% or more.

(3) Hot rolling is completed at temperature T2 (° C.) or higher represented by Expression (3).

(4) Cooling is started within 1.5 seconds after the completion of the hot rolling, and the temperature is cooled to temperature T3 (° C.) or lower represented by Expression (4) at an average cooling rate of 50° C./sec or higher.

(5) Cooling from the cooling stop temperature of the cooling to the coiling temperature is performed at an average cooling rate of 10° C./sec or higher.

(6) Coiling is performed at (T4−100)° C. to (T4+50)° C. with respect to the temperature T4 (° C.) represented by Expression (5).

(7) In cooling after coiling, cooling is performed so that the lower limit of the incubation time satisfies Condition I (one or more of 80 seconds or longer at 450° C. or higher, 200 seconds or longer at 400° C. or higher, and 1000 seconds or longer at 350° C. or higher), and the upper limit of the incubation time satisfies Condition II (all of within 2000 seconds at 450° C. or higher, within 8000 seconds at 400° C. or higher, and within 30000 seconds at 350° C. or higher) in a predetermined temperature range at the endmost portion of the hot-rolled steel sheet in the sheet width direction and at the center portion of the hot-rolled steel sheet in the sheet width direction.

$$T1(^\circ\text{C.})=-273.15+6770/(2.25-\log([Nb]\times[C])) \quad (2)$$

$$T2(^\circ\text{C.})=868-396\times[C]-68.1\times[Mn]+24.6\times[Si]-36.1\times[Ni]-24.8\times[Cr]-20.7\times[Cu]+250\times[Al] \quad (3)$$

$$T3(^\circ\text{C.})=770-270\times[C]-90\times[Mn]-37\times[Ni]-70\times[Cr]-83\times[Mo] \quad (4)$$

$$T4(^\circ\text{C.})=591-474\times[C]-33\times[Mn]-17\times[Ni]-17\times[Cr]-21\times[Mo] \quad (5)$$

Herein, the [element symbol] in each expression indicates the content (mass %) of each element in the steel, and 0 is substituted in a case where the element is not contained. In addition, the log in Expression (2) indicates a common logarithm having a base of 10.

(5-1) Slab, Slab Temperature when Subjected to Hot Rolling, and Aspect of Hot Rolling As a slab to be subjected to hot rolling, a slab obtained by continuous casting, a slab obtained by casting and blooming, and the like can be used, and slabs obtained by performing hot working or cold working on these slabs as necessary can be used.

The temperature of the slab to be subjected to hot rolling may be a temperature at which NbC precipitated during casting can be solutionized, and is set to T1 (° C.) or higher represented by Expression (2). From the viewpoint of suppressing scale loss, the slab heating temperature is preferably 1350° C. or lower. In a case where the slab to be subjected to hot rolling is a slab obtained by continuous casting or a slab obtained by blooming and is in a high temperature state (T1 (° C.) or higher), the slab may be subjected to hot rolling as it is without heating.

In hot rolling, it is preferable to use a reverse mill or a tandem mill for multi-pass rolling. Particularly, from the viewpoint of industrial productivity, it is more preferable that at least the final several stages are hot-rolled using a tandem mill.

(5-2) Rolling Reduction of Hot Rolling: Total Sheet Thickness Reduction of 90% or More in Temperature Range of 850° C. to 1100° C.

By performing hot rolling so that the total sheet thickness reduction is 90% or more in the temperature range of 850° C. to 1100° C., recrystallized austenite grains are mainly refined, accumulation of strain energy in unrecrystallized austenite grains is promoted, and thus the average grain size of the bainite and the tempered martensite, which are the primary phases, becomes finer. Accordingly, hot rolling is performed in a temperature range of 850° C. to 1100° C. so that the total sheet thickness is reduced by 90% or more. The sheet thickness reduction in a temperature range of 850° C. to 1100° C. can be expressed as $(t_0-t_1)/t_0\times100(\%)$ when an inlet sheet thickness before the first pass in the rolling in this temperature range is to and an outlet sheet thickness after the final pass in the rolling in this temperature range is $t_1$.

(5-3) Hot Rolling Completion Temperature: T2 (° C.) or Higher

The hot rolling completion temperature is T2 (° C.) or higher. By setting the hot rolling completion temperature to T2 (° C.) or higher, an excessive increase in the number of ferrite nucleation sites in the austenite can be suppressed, and the area fraction of the ferrite in the final structure (the metallographic structure of the hot-rolled steel sheet after manufacturing) can be suppressed to 5.0% or less.

(5-4) Cooling After Completion of Hot Rolling: Starting Cooling Within 1.5 Seconds and Performing Cooling to T3 (° C.) or Lower at Average Cooling Rate of 50° C./Sec or Higher In order to suppress the growth of austenite crystal grains refined by hot rolling, cooling is performed to T3 (° C.) or lower within 1.5 seconds after the completion of hot rolling at an average cooling rate of 50° C./sec or higher.

By performing cooling to T3 (° C.) or lower within 1.5 seconds after the completion of hot rolling at an average cooling rate of 50° C./sec or higher, the formation of ferrite and pearlite is suppressed, and thus the area fraction of the bainite and the tempered martensite can be increased. Thus, the uniformity in the metallographic structure is improved, and the strength and stretch flangeability of the steel sheet are improved. The average cooling rate referred to herein is a value obtained by dividing the temperature drop width of the steel sheet from the start of cooling (when the steel sheet is introduced into cooling equipment) to the completion of cooling (when the steel sheet is extracted from the cooling equipment) by the time required from the start of cooling to the completion of cooling. In the cooling after the completion of hot rolling, when the time to start cooling is longer than 1.5 seconds, the average cooling rate is lower than 50° C./sec, or the cooling stop temperature is higher than T3 (° C.), the ferritic transformation and/or pearlitic transformation inside the steel sheet becomes remarkable, and it becomes difficult to obtain a metallographic structure including bainite and tempered martensite as primary phases. Therefore, within 1.5 seconds after the completion of hot rolling, cooling is performed to T3 (° C.) or lower at an average cooling rate of 50° C./sec or higher. The upper limit value of the cooling rate is not particularly specified, but when the cooling rate is increased, the cooling equipment becomes large and the equipment cost increases. Therefore, considering the equipment cost, the average cooling rate is preferably 300° C./sec or lower. The cooling stop temperature may be (T4−100)° C. or higher.

(5-5) Average Cooling Rate from Cooling Stop Temperature of Cooling to Coiling Temperature: 10° C./Sec or Higher In order to suppress the area fraction of the pearlite to 5.0% or less, the average cooling rate from the cooling stop temperature of the cooling to the coiling temperature is set to 10° C./sec or higher. As a result, the area fraction of the bainite and the tempered martensite is increased, and the balance between the strength and stretch flangeability of the steel sheet can be improved. The average cooling rate referred to here is a value obtained by dividing the temperature drop width of the steel sheet from the start of cooling stop temperature of the cooling to the coiling temperature by the time required from the stop of cooling to coiling. When the average cooling rate is lower than 10° C./sec, the area fraction of the pearlite is increased, the strength is decreased, and the ductility is decreased. Therefore, the average cooling rate from the cooling stop temperature to the coiling temperature in the cooling is set to 10° C./sec or higher. The upper limit value of the cooling rate is not particularly specified, but when the cooling rate is increased, the cooling equipment becomes large and the equipment cost increases. Therefore, considering the equipment cost, the average cooling rate is preferably 300° C./sec or lower.

(5-6) Coiling Temperature: (T4−100)° C. to (T4+50)° C.

The coiling temperature is (T4−100)° C. to (T4+50)° C. When the coiling temperature is lower than (T4−100)° C., carbon is not sufficiently diffused from the bainite and the tempered martensite into the austenite and the austenite is not stabilized. Therefore, it is difficult to obtain residual austenite having an area fraction of 3.0% or more, and the ductility of the steel sheet is decreased. In addition, the low temperature toughness of the steel sheet is also deteriorated due to a decrease in the number density of iron-based carbides. Further, in a case where the coiling temperature is higher than (T4+50)° C., carbon diffused from the bainite and the tempered martensite is excessively precipitated in the steel as iron-based carbides. Therefore, carbon is not sufficiently concentrated in the austenite and it is difficult to set the C concentration in the residual austenite to 0.5 mass % or more. Accordingly, the coiling temperature is set to (T4−100)° C. to (T4+50)° C.

(5-7) Cooling after Coiling: Cooling is Performed so that Lower Limit of Incubation Time Satisfies Condition I, and Upper Limit of Incubation Time Satisfies Condition II in Predetermined Temperature Range at Endmost Portion of Hot-Rolled Steel Sheet in Sheet Width Direction and at Center Portion of Hot-Rolled Steel Sheet in Sheet Width Direction.

Condition I: one or more of 80 seconds or longer at 450° C. or higher, 200 seconds or longer at 400° C. or higher, and 1000 seconds or longer at 350° C. or higher Condition II: all of within 2000 seconds at 450° C. or higher, within 8000 seconds at 400° C. or higher, and within 30000 seconds at 350° C. or higher In cooling after coiling, by performing cooling so that the lower limit of the incubation time satisfies Condition I in a predetermined temperature range at the endmost portion of the hot-rolled steel sheet in the sheet width direction and at the center portion of the hot-rolled steel sheet in the sheet width direction, that is, by securing the incubation time satisfying one or more of 80 seconds or longer at 450° C. or higher, 200 seconds or longer at 400° C. or higher, and 1000 seconds or longer at 350° C. or higher, the diffusion of carbon from the bainite and the tempered martensite to the austenite is promoted, the area fraction of the residual austenite is increased, and the decomposition of the residual austenite is easily suppressed. In the embodiment, the temperature at the endmost portion of the hot-rolled steel sheet in the sheet width direction is measured with a contact-type or non-contact-type thermometer. The temperature at the center portion of the hot-rolled steel sheet in the sheet width direction is measured with a thermocouple or calculated by heat transfer analysis. When the lower limit of the incubation time does not satisfy Condition 1, that is, the incubation time does not satisfy all of 80 seconds or longer at 450° C. or higher, 200 seconds or longer at 400° C. or higher, and 1000 seconds or longer at 350° C. or higher, carbon is not sufficiently diffused from the bainite and the tempered martensite to the austenite, and it is difficult to set the area fraction of the residual austenite to 3.0% or more and to set the C concentration in the residual austenite to 0.5 mass % or more. Thus, the ductility of the steel sheet is decreased.

On the other hand, in the cooling after coiling, when the upper limit of the incubation time in the predetermined temperature range of the endmost portion of the hot-rolled steel sheet in the sheet width direction and the center portion of the hot-rolled steel sheet in the sheet width direction does not satisfy Condition II, that is, the incubation time corresponds at least one of longer than 2000 seconds at 450° C. or higher, longer than 8000 seconds at 400° C. or higher, or longer than 30000 seconds at 350° C. or higher, austenite is decomposed into iron-based carbides and tempered martensite, and thus the ductility of the steel sheet is decreased. Therefore, the cooling is performed so that the upper limit of the incubation time satisfies Condition II, that is, the upper limit of the incubation time satisfies all of within 2000 seconds at 450° C. or higher, within 8000 seconds at 400° C. or higher, and within 30000 seconds at 350° C. or higher. Thus, in the cooling after coiling, cooling is performed so that the lower limit of the incubation time satisfies Condition I (one or more of 80 seconds or longer at 450° C. or higher, 200 seconds or longer at 400° C. or higher, and 1000 seconds or longer at 350° C. or higher), and the upper limit of the incubation time satisfies Condition II (all of within 2000 seconds at 450° C. or higher, within 8000 seconds at 400° C. or higher, and within 30000 seconds at 350° C. or higher) in the predetermined temperature range at the endmost portion of the hot-rolled steel sheet in the sheet width direction and at the center portion of the hot-rolled steel sheet in the sheet width direction. Cooling of the endmost portion of the hot-rolled steel sheet in the sheet width direction and the center portion of the hot-rolled steel sheet in the sheet width direction after coiling may be controlled by a heat insulating cover, an edge mask, mist cooling, or the like.

EXAMPLES

Next, the effects of one aspect of the present invention will be described more specifically by way of examples, but the conditions in the examples are condition examples adopted for confirming the feasibility and effects of the present invention. The present invention is not limited to these condition examples. In the present invention, various conditions can be adopted as long as the object of the present invention can be achieved without departing from the gist of the present invention.

Steels having chemical compositions shown in Steel Nos. A to Z in Tables 1 and 2 were melted and continuously cast to manufacture slabs having a thickness of 240 to 300 mm. The obtained slabs were used to obtain hot-rolled steel sheets under the manufacturing conditions shown in Tables 3 to 6.

In addition, Manufacturing No. 35 was cold-rolled at the cold rolling reduction shown in Table 6 after coiling and annealed at the annealing holding temperature and the annealing holding time shown in Table 6. Thereafter, the steel sheet was cooled to the cooling stop temperature at the primary cooling rate shown in Table 6 and then held for the hold time after cooling shown in Table 6. In Table 5, regarding Manufacturing No. 35, the incubation time after hot rolling and coiling are performed and before annealing in Table 6 is performed is shown.

In addition, cooling of Manufacturing Nos. 36 and 37 was once stopped at the incubation temperature shown in Table 4 in cooling after hot rolling, and the steel sheets were retained only for the incubation time shown in Table 4 at the incubation temperature and then cooled again.

TABLE 1

| Steel | Mass % Remainder including Fe and impurities | | | | | | | | | | | | | | | | |
|---|---|---|---|---|---|---|---|---|---|---|---|---|---|---|---|---|---|
| No. | C | Si | Mn | Nb | sol. Al | P | S | N | O | Ti | V | Cu | Cr | Mo | Ni | B | Remarks |
| A | 0.128 | 2.09 | 2.12 | 0.015 | 0.025 | 0.017 | 0.0023 | 0.0008 | 0.0045 | | | | | | | | Invention Steel |
| B | 0.191 | 2.17 | 1.90 | 0.020 | 0.027 | 0.012 | 0.0009 | 0.0021 | 0.0040 | | | | | | | | Invention Steel |
| C | 0.248 | 2.07 | 2.14 | 0.017 | 0.022 | 0.017 | 0.0020 | 0.0030 | 0.0019 | | | | | | | | Invention Steel |
| D | 0.217 | 0.36 | 2.59 | 0.017 | 1.503 | 0.025 | 0.0016 | 0.0026 | 0.0025 | | | | | | | | Invention Steel |
| E | 0.190 | 2.80 | 2.08 | 0.019 | 0.027 | 0.025 | 0.0009 | 0.0021 | 0.0012 | | | | | | | | Invention Steel |
| F | 0.204 | 2.01 | 1.11 | 0.012 | 0.033 | 0.017 | 0.0030 | 0.0010 | 0.0016 | | | | | | | | Invention Steel |
| G | 0.214 | 2.18 | 3.40 | 0.011 | 0.022 | 0.018 | 0.0038 | 0.0033 | 0.0044 | | | | | | | | Invention Steel |
| H | 0.192 | 1.91 | 1.89 | 0.043 | 0.032 | 0.017 | 0.0013 | 0.0029 | 0.0013 | | | | | | | | Invention Steel |
| I | 0.181 | 1.97 | 2.04 | 0.010 | 0.019 | 0.016 | 0.0044 | 0.0012 | 0.0014 | 0.038 | | | | | | | Invention Steel |
| J | 0.209 | 1.89 | 2.11 | 0.010 | 0.029 | 0.026 | 0.0014 | 0.0041 | 0.0043 | | 0.040 | | | | | | Invention Steel |

TABLE 1-continued

| Steel | Mass % Remainder including Fe and impurities | | | | | | | | | | | | | | | | |
|---|---|---|---|---|---|---|---|---|---|---|---|---|---|---|---|---|---|
| No. | C | Si | Mn | Nb | sol. Al | P | S | N | O | Ti | V | Cu | Cr | Mo | Ni | B | Remarks |
| K | 0.212 | 2.06 | 1.94 | 0.018 | 0.018 | 0.016 | 0.0009 | 0.0013 | 0.0019 | | | 0.03 | | | | | Invention Steel |
| L | 0.219 | 1.88 | 2.14 | 0.015 | 0.018 | 0.021 | 0.0009 | 0.0048 | 0.0025 | | | | 0.14 | | | | Invention Steel |
| M | 0.201 | 1.92 | 1.99 | 0.013 | 0.033 | 0.016 | 0.0039 | 0.0020 | 0.0006 | | | | | 0.180 | | | Invention Steel |
| N | 0.208 | 1.91 | 1.90 | 0.020 | 0.030 | 0.014 | 0.0016 | 0.0011 | 0.0056 | | | | | | 0.19 | | Invention Steel |
| O | 0.204 | 2.20 | 2.06 | 0.013 | 0.024 | 0.024 | 0.0023 | 0.0012 | 0.0027 | | | | | | | 0.0021 | Invention Steel |
| P | 0.088 | 1.97 | 2.04 | 0.011 | 0.030 | 0.019 | 0.0047 | 0.0035 | 0.0031 | | | | | | | | Comparative Steel |
| Q | 0.299 | 2.02 | 2.16 | 0.010 | 0.025 | 0.013 | 0.0009 | 0.0017 | 0.0023 | | | | | | | | Comparative Steel |
| R | 0.200 | 0.02 | 2.11 | 0.009 | 0.029 | 0.011 | 0.0013 | 0.0049 | 0.0022 | | | | | | | | Comparative Steel |
| S | 0.187 | 2.02 | 0.85 | 0.014 | 0.023 | 0.018 | 0.0033 | 0.0009 | 0.0049 | | | | | | | | Comparative Steel |
| T | 0.208 | 2.11 | 4.12 | 0.017 | 0.032 | 0.022 | 0.0023 | 0.0035 | 0.0030 | | | | | | | | Comparative Steel |
| U | 0.208 | 1.90 | 2.19 | 0.000 | 0.020 | 0.013 | 0.0034 | 0.0031 | 0.0014 | | | | | | | | Comparative Steel |
| V | 0.169 | 2.19 | 2.11 | 0.058 | 0.021 | 0.024 | 0.0011 | 0.0036 | 0.0027 | | | | | | | | Comparative Steel |
| W | 0.109 | 0.94 | 2.03 | 0.025 | 0.030 | 0.009 | 0.0028 | 0.0015 | 0.0022 | | | | | | | 0.0013 | Invention Steel |
| X | 0.150 | 1.50 | 1.50 | 0.030 | 0.031 | 0.021 | 0.0048 | 0.0030 | 0.0035 | | | | | | | | Invention Steel |
| Y | 0.180 | 1.95 | 2.07 | 0.000 | 0.042 | 0.015 | 0.0090 | 0.0032 | 0.0035 | | | | | | | | Comparative Steel |
| Z | 0.180 | 1.99 | 2.00 | 0.005 | 0.051 | 0.015 | 0.0010 | 0.0030 | 0.0027 | | | | | | | | Invention Steel |

TABLE 2

| Steel | Mass % Remainder including Fe and impurities | | | | | | | | | | | | | |
|---|---|---|---|---|---|---|---|---|---|---|---|---|---|---|
| No. | Ca | Mg | REM | Bi | Zr | Co | Zn | W | Sn | T1 | T2 | T3 | T4 | Remarks |
| A | 0.0024 | 0.0017 | | | | | | | | 1090 | 731 | 545 | 460 | Invention Steel |
| B | | | | | | | | | | 1177 | 723 | 547 | 438 | Invention Steel |
| C | | | 0.0017 | | | | | | | 1191 | 680 | 510 | 403 | Invention Steel |
| D | | | | 0.003 | | | | | | 1172 | 990 | 478 | 403 | Invention Steel |
| E | | | | | | | | | | 1170 | 727 | 532 | 432 | Invention Steel |
| F | | | | | | | | | | 1120 | 769 | 615 | 458 | Invention Steel |
| G | | | | | | | | | | 1115 | 611 | 406 | 377 | Invention Steel |
| H | | | | | 0.08 | | | | | 1289 | 718 | 548 | 438 | Invention Steel |
| I | | | | | | | | | | 1083 | 711 | 538 | 438 | Invention Steel |
| J | | | | | | | | 0.03 | | 1100 | 695 | 524 | 422 | Invention Steel |
| K | | | | | | 0.07 | | | | 1177 | 706 | 538 | 426 | Invention Steel |
| L | | | | | | | | | | 1157 | 683 | 508 | 414 | Invention Steel |
| M | | | | | | | | | 0.018 | 1128 | 708 | 522 | 426 | Invention Steel |
| N | | | | | | | | | | 1189 | 704 | 536 | 426 | Invention Steel |
| O | | | | | | | 0.14 | | | 1130 | 707 | 530 | 426 | Invention Steel |
| P | | | | | | | | | | 1013 | 750 | 563 | 482 | Comparative Steel |
| Q | | | | | | | | | | 1145 | 658 | 495 | 378 | Comparative Steel |

TABLE 2-continued

| Steel | Mass % Remainder including Fe and impurities | | | | | | | | | | | | | |
|---|---|---|---|---|---|---|---|---|---|---|---|---|---|---|
| No. | Ca | Mg | REM | Bi | Zr | Co | Zn | W | Sn | T1 | T2 | T3 | T4 | Remarks |
| R | | | | | | | | | | 1082 | 653 | 526 | 427 | Comparative Steel |
| S | | | | | | | | | | 1128 | 792 | 643 | 474 | Comparative Steel |
| T | | | | | | | | | | 1167 | 565 | 343 | 356 | Comparative Steel |
| U | | | | | | | | | | 703 | 688 | 517 | 420 | Comparative Steel |
| V | | | | | | | | | | 1317 | 717 | 534 | 441 | Comparative Steel |
| W | | | | | | | | | | 1133 | 717 | 558 | 472 | Invention Steel |
| X | | | | | | | | | | 1200 | 751 | 595 | 470 | Invention Steel |
| Y | | | | | | | | | | 695 | 714 | 535 | 437 | Comparative Steel |
| Z | | | | | | | | | | 1005 | 722 | 541 | 440 | Invention Steel |

TABLE 3

| Manufacturing No. | Steel No. | T1 | Slab heating temperature (° C.) | Sheet thickness reduction at 850° C. to 1100° C | T2 | Hot rolling completion temperature (° C.) | Time until cooling start (sec) | Average cooling rate (° C./s) | incubation temperature (° C.) | Incubation time (s) | Average cooling rate until cooling stop after incubation (° C/s) |
|---|---|---|---|---|---|---|---|---|---|---|---|
| 1 | A | 1090 | 1219 | 91 | 731 | 881 | 1.1 | 64 | — | — | — |
| 2 | B | 1177 | 1216 | 92 | 723 | 890 | 0.7 | 84 | — | — | — |
| 3 | B | 1177 | 1207 | 87 | 723 | 905 | 0.9 | 88 | — | — | — |
| 4 | B | 1177 | 1227 | 90 | 723 | 719 | 1.1 | 117 | — | — | — |
| 5 | B | 1177 | 1237 | 91 | 723 | 905 | 1.8 | 110 | — | — | — |
| 6 | B | 1177 | 1226 | 91 | 723 | 912 | 1.0 | 43 | — | — | — |
| 7 | B | 1177 | 1233 | 93 | 723 | 898 | 0.6 | 109 | — | — | — |
| 8 | B | 1177 | 1237 | 90 | 723 | 906 | 1.1 | 121 | — | — | — |
| 9 | B | 1177 | 1237 | 90 | 723 | 917 | 1.0 | 114 | — | — | — |
| 10 | B | 1177 | 1206 | 93 | 723 | 900 | 0.9 | 73 | — | — | — |
| 11 | B | 1177 | 1198 | 93 | 723 | 919 | 1.1 | 87 | — | — | — |
| 12 | B | 1177 | 1226 | 92 | 723 | 906 | 0.8 | 64 | — | — | — |
| 13 | B | 1177 | 1220 | 93 | 723 | 902 | 1.0 | 91 | — | — | — |
| 14 | C | 1191 | 1215 | 92 | 680 | 899 | 1.1 | 92 | — | — | — |
| 15 | D | 1172 | 1199 | 90 | 990 | 1005 | 0.6 | 100 | — | — | — |
| 16 | E | 1170 | 1229 | 91 | 727 | 897 | 0.9 | 108 | — | — | — |
| 17 | F | 1120 | 1201 | 92 | 769 | 911 | 0.6 | 79 | — | — | — |
| 18 | G | 1115 | 1228 | 91 | 611 | 884 | 0.7 | 77 | — | — | — |
| 19 | H | 1289 | 1294 | 91 | 718 | 900 | 0.8 | 76 | — | — | — |
| 20 | I | 1083 | 1207 | 91 | 711 | 917 | 0.8 | 94 | — | — | — |

| Manufacturing No. | T3 | Cooling stop temperature (° C.) | Average cooling rate from cooling stop temperature to coiling temperature (° C./s) | T4 + 50 | Coiling temperature (° C.) | T4 − 100 | Remarks |
|---|---|---|---|---|---|---|---|
| 1 | 545 | 426 | 29 | 510 | 382 | 360 | Invention Example |
| 2 | 547 | 400 | 31 | 488 | 367 | 338 | Invention Example |
| 3 | 547 | 400 | 16 | 488 | 381 | 338 | Comparative Example |
| 4 | 547 | 407 | 15 | 488 | 351 | 338 | Comparative Example |
| 5 | 547 | 392 | 25 | 488 | 384 | 338 | Comparative Example |
| 6 | 547 | 405 | 22 | 488 | 379 | 338 | Comparative Example |
| 7 | 547 | 560 | 21 | 488 | 376 | 338 | Comparative Example |
| 8 | 547 | 411 | 6 | 488 | 361 | 338 | Comparative Example |
| 9 | 547 | 528 | 18 | 488 | 492 | 338 | Comparative Example |
| 10 | 547 | 320 | 24 | 488 | 286 | 338 | Comparative Example |
| 11 | 547 | 519 | 16 | 488 | 470 | 338 | Comparative Example |
| 12 | 547 | 460 | 18 | 488 | 439 | 338 | Comparative Example |
| 13 | 547 | 401 | 21 | 488 | 377 | 338 | Comparative Example |
| 14 | 510 | 491 | 27 | 453 | 448 | 303 | Invention Example |
| 15 | 478 | 417 | 15 | 453 | 371 | 303 | Invention Example |
| 16 | 532 | 427 | 25 | 482 | 370 | 332 | Invention Example |
| 17 | 615 | 510 | 22 | 508 | 482 | 358 | Invention Example |

TABLE 3-continued

| | | | | | | | |
|---|---|---|---|---|---|---|---|
| 18 | 406 | 395 | 27 | 427 | 373 | 277 | Invention Example |
| 19 | 548 | 398 | 28 | 488 | 375 | 338 | Invention Example |
| 20 | 538 | 463 | 24 | 488 | 419 | 338 | Invention Example |

TABLE 4

| Manufacturing No. | Steel No. | T1 | Slab heating temperature (° C.) | Sheet thickness reduction at 850° C. to 1100° C | T2 | Hot rolling completion temperature (° C.) | Time until cooling start (sec) | Average cooling rate (° C./s) | incubation temperature (° C.) | Incubation time (s) | Average cooling rate until cooling stop after incubation (° C/s) |
|---|---|---|---|---|---|---|---|---|---|---|---|
| 21 | J | 1100 | 1212 | 92 | 695 | 904 | 1.1 | 112 | — | — | — |
| 22 | K | 1177 | 1226 | 91 | 706 | 900 | 1.0 | 80 | — | — | — |
| 23 | L | 1157 | 1201 | 90 | 683 | 882 | 0.9 | 111 | — | — | — |
| 24 | M | 1128 | 1198 | 91 | 708 | 903 | 0.9 | 74 | — | — | — |
| 25 | N | 1189 | 1229 | 93 | 704 | 890 | 0.9 | 108 | — | — | — |
| 26 | O | 1130 | 1211 | 92 | 707 | 902 | 0.6 | 119 | — | — | — |
| 27 | P | 1013 | 1230 | 93 | 750 | 895 | 1.0 | 118 | — | — | — |
| 28 | Q | 1145 | 1219 | 91 | 658 | 880 | 0.8 | 93 | — | — | — |
| 29 | R | 1082 | 1203 | 92 | 653 | 899 | 0.9 | 109 | — | — | — |
| 30 | S | 1128 | 1201 | 93 | 792 | 887 | 1.0 | 93 | — | — | — |
| 31 | T | 1167 | 1225 | 93 | 565 | 904 | 0.9 | 100 | — | — | — |
| 32 | U | 703 | 1226 | 90 | 688 | 910 | 0.8 | 90 | — | — | — |
| 33 | V | 1317 | 1320 | 90 | 717 | 909 | 0.8 | 116 | — | — | — |
| 34 | W | 1133 | 1240 | 91 | 717 | 950 | 0.8 | 78 | — | — | — |
| 35 | X | 1200 | 1234 | 92 | 751 | 938 | 1.5 | 80 | — | — | — |
| 36 | Y | 695 | 1217 | 93 | 714 | 904 | 0.1 | 290 | 780 | 2 | 230 |
| 37 | Z | 1005 | 1220 | 90 | 722 | 892 | 0.1 | 250 | 840 | 1 | 200 |

| Manufacturing No. | T3 | Cooling stop temperature (° C.) | Average cooling rate from cooling stop temperature to coiling temperature (° C./s) | T4 + 50 | Coiling temperature (° C.) | T4 − 100 | Remarks |
|---|---|---|---|---|---|---|---|
| 21 | 524 | 396 | 30 | 472 | 368 | 322 | Invention Example |
| 22 | 538 | 397 | 30 | 476 | 365 | 326 | Invention Example |
| 23 | 508 | 400 | 26 | 464 | 365 | 314 | Invention Example |
| 24 | 522 | 408 | 19 | 476 | 382 | 326 | Invention Example |
| 25 | 536 | 422 | 27 | 476 | 363 | 326 | Invention Example |
| 26 | 530 | 409 | 30 | 476 | 364 | 326 | Invention Example |
| 27 | 563 | 396 | 30 | 532 | 382 | 382 | Comparative Example |
| 28 | 495 | 424 | 27 | 428 | 370 | 278 | Comparative Example |
| 29 | 526 | 424 | 24 | 477 | 365 | 327 | Comparative Example |
| 30 | 643 | 396 | 17 | 524 | 380 | 374 | Comparative Example |
| 31 | 343 | 330 | 30 | 406 | 318 | 256 | Comparative Example |
| 32 | 517 | 391 | 31 | 470 | 364 | 320 | Comparative Example |
| 33 | 534 | 419 | 22 | 491 | 376 | 341 | Comparative Example |
| 34 | 558 | 432 | 30 | 522 | 390 | 372 | Comparative Example |
| 35 | 595 | 348 | 31 | 520 | 332 | 370 | Comparative Example |
| 36 | 535 | 430 | 80 | 487 | 400 | 337 | Comparative Example |
| 37 | 541 | 452 | 65 | 490 | 425 | 340 | Comparative Example |

TABLE 5

| | Endmost portion of hot-rolled steel sheet in sheet width direction | | | Center portion of hot-rolled steel sheet in sheet width direction | | | |
|---|---|---|---|---|---|---|---|
| Manufacturing No. | Incubation time at 450° C. or higher (s) | Incubation time at 400° C. or higher (s) | Incubation time at 350° C. or higher (s) | Incubation time at 450° C. or higher (s) | Incubation time at 400° C. or higher (s) | Incubation time at 350° C. or higher (s) | Remarks |
| 1 | 0 | 0 | 1600 | 0 | 0 | 15600 | Invention Example |
| 2 | 0 | 0 | 1500 | 0 | 0 | 9200 | Invention Example |
| 3 | 0 | 0 | 1800 | 0 | 0 | 15500 | Comparative Example |
| 4 | 0 | 0 | 1100 | 0 | 0 | 2400 | Comparative Example |
| 5 | 0 | 0 | 1600 | 0 | 0 | 15300 | Comparative Example |
| 6 | 0 | 0 | 1500 | 0 | 0 | 13700 | Comparative Example |
| 7 | 0 | 0 | 1800 | 0 | 0 | 13700 | Comparative Example |
| 8 | 0 | 0 | 1400 | 0 | 0 | 14200 | Comparative Example |
| 9 | 800 | 900 | 7400 | 1700 | 7600 | 27100 | Comparative Example |
| 10 | 0 | 0 | 0 | 0 | 0 | 0 | Comparative Example |

TABLE 5-continued

| Manufacturing No. | Endmost portion of hot-rolled steel sheet in sheet width direction: Incubation time at 450° C. or higher (s) | Endmost portion: Incubation time at 400° C. or higher (s) | Endmost portion: Incubation time at 350° C. or higher (s) | Center portion of hot-rolled steel sheet in sheet width direction: Incubation time at 450° C. or higher (s) | Center portion: Incubation time at 400° C. or higher (s) | Center portion: Incubation time at 350° C. or higher (s) | Remarks |
|---|---|---|---|---|---|---|---|
| 11 | 500 | 900 | 1600 | 2300 | 7900 | 14900 | Comparative Example |
| 12 | 0 | 700 | 1200 | 0 | 15200 | 28500 | Comparative Example |
| 13 | 0 | 0 | 24700 | 0 | 0 | 34000 | Comparative Example |
| 14 | 0 | 500 | 5300 | 0 | 6000 | 21800 | Invention Example |
| 15 | 0 | 0 | 1300 | 0 | 0 | 9800 | Invention Example |
| 16 | 0 | 0 | 1800 | 0 | 0 | 10300 | Invention Example |
| 17 | 900 | 4500 | 9700 | 2000 | 8000 | 29500 | Invention Example |
| 18 | 0 | 0 | 1300 | 0 | 0 | 12000 | Invention Example |
| 19 | 0 | 0 | 1800 | 0 | 0 | 13500 | Invention Example |
| 20 | 0 | 600 | 5600 | 0 | 6400 | 20600 | Invention Example |
| 21 | 0 | 0 | 1200 | 0 | 0 | 11000 | Invention Example |
| 22 | 0 | 0 | 1600 | 0 | 0 | 9200 | Invention Example |
| 23 | 0 | 0 | 1100 | 0 | 0 | 7200 | Invention Example |
| 24 | 0 | 0 | 1700 | 0 | 0 | 16100 | Invention Example |
| 25 | 0 | 0 | 1500 | 0 | 0 | 7300 | Invention Example |
| 26 | 0 | 0 | 1300 | 0 | 0 | 7000 | Invention Example |
| 27 | 0 | 0 | 2400 | 0 | 0 | 16500 | Comparative Example |
| 28 | 0 | 0 | 1700 | 0 | 0 | 9500 | Comparative Example |
| 29 | 0 | 0 | 1500 | 0 | 0 | 7100 | Comparative Example |
| 30 | 0 | 0 | 1500 | 0 | 0 | 12900 | Comparative Example |
| 31 | 0 | 0 | 1000 | 0 | 0 | 13900 | Comparative Example |
| 32 | 0 | 0 | 1300 | 0 | 0 | 6700 | Comparative Example |
| 33 | 0 | 0 | 1900 | 0 | 0 | 13500 | Comparative Example |
| 34 | 0 | 0 | 100 | 0 | 0 | 900 | Comparative Example |
| 35 | 0 | 0 | 0 | 0 | 0 | 0 | Comparative Example |
| 36 | 0 | 0 | 3900 | 0 | 0 | 13000 | Comparative Example |
| 37 | 0 | 100 | 900 | 0 | 6500 | 15000 | Comparative Example |

TABLE 6

| Manufacturing No. | Cold rolling reduction (%) | Annealing holding temperature (° C.) | Annealing holding time (s) | Primary cooling rate (° C./s) | Cooling stop temperature (° C.) | Hold time after cooling (s) |
|---|---|---|---|---|---|---|
| 1 | — | — | — | — | — | — |
| 2 | — | — | — | — | — | — |
| 3 | — | — | — | — | — | — |
| 4 | — | — | — | — | — | — |
| 5 | — | — | — | — | — | — |
| 6 | — | — | — | — | — | — |
| 7 | — | — | — | — | — | — |
| 8 | — | — | — | — | — | — |
| 9 | — | — | — | — | — | — |
| 10 | — | — | — | — | — | — |
| 11 | — | — | — | — | — | — |
| 12 | — | — | — | — | — | — |
| 13 | — | — | — | — | — | — |
| 14 | — | — | — | — | — | — |
| 15 | — | — | — | — | — | — |
| 16 | — | — | — | — | — | — |
| 17 | — | — | — | — | — | — |
| 18 | — | — | — | — | — | — |
| 19 | — | — | — | — | — | — |
| 20 | — | — | — | — | — | — |
| 21 | — | — | — | — | — | — |
| 22 | — | — | — | — | — | — |
| 23 | — | — | — | — | — | — |
| 24 | — | — | — | — | — | — |
| 25 | — | — | — | — | — | — |
| 26 | — | — | — | — | — | — |
| 27 | — | — | — | — | — | — |
| 28 | — | — | — | — | — | — |
| 29 | — | — | — | — | — | — |
| 30 | — | — | — | — | — | — |
| 31 | — | — | — | — | — | — |
| 32 | — | — | — | — | — | — |
| 33 | — | — | — | — | — | — |

TABLE 6-continued

| Manufacturing No. | Cold rolling reduction (%) | Annealing holding temperature (° C.) | Annealing holding time (s) | Primary cooling rate (° C./s) | Cooling stop temperature (° C.) | Hold time after cooling (s) |
|---|---|---|---|---|---|---|
| 34 | — | — | — | — | — | — |
| 35 | 10 | 800 | 40 | 32 | 400 | 30 |
| 36 | — | — | — | — | — | — |
| 37 | — | — | — | — | — | — |

The metallographic structures of the hot-rolled steel sheets of Manufacturing Nos. 1 to 37 obtained were observed by the above-mentioned method and the area fraction, the average grain size, and the number density of iron-based carbides of each phase were obtained. In addition, the hot-rolled steel sheets of Manufacturing Nos. 1 to 37 were subjected to X-ray diffraction by the above-mentioned method and the C concentration in the residual austenite was obtained. The obtained measurement results are shown in Tables 7 to 9.

$\gamma$, $\gamma_{D1}$, $\gamma_{D2}$, $\gamma_{W1}$, and $\gamma_{W2}$ in Table 8 refer to the area fractions of the residual austenite in the metallographic structures at the sheet thickness ¼ depth from the surface and at the center position in the sheet width direction, at the sheet thickness ¼ depth from the surface and at a position 300 mm from the center position in the sheet width direction to one end side in the sheet width direction, at the sheet thickness ¼ depth from the surface and at a position 600 mm from the center position in the sheet width direction to the one end side in the sheet width direction, at the sheet thickness ¼ depth from the surface and at a position 300 mm from the center position in the sheet width direction to the other end side in the sheet width direction, and at the sheet thickness ¼ depth from the surface and at a position 600 mm from the center position in the sheet width direction to the other end side in the sheet width cross section parallel to the rolling direction.

$C\gamma_C$, $C\gamma_{D1}$, $C\gamma_{D2}$, $C\gamma_{W1}$, and $C\gamma_{W2}$ in Table 9 refer to the C concentrations by mass % in the residual austenite in the metallographic structures at the sheet thickness ¼ depth from the surface and at the center position in the sheet width direction, at the sheet thickness ¼ depth from the surface and at the position 300 mm from the center position in the sheet width direction to one end side in the sheet width direction, at the sheet thickness ¼ depth from the surface and at the position 600 mm from the center position in the sheet width direction to the one end side in the sheet width direction, at the sheet thickness ¼ depth from the surface and at the position 300 mm from the center position in the sheet width direction to the other end side in the sheet width direction, and at the sheet thickness ¼ depth from the surface and at the position 600 mm from the center position in the sheet width direction to the other end side in the sheet width cross section parallel to the rolling direction.

TABLE 7

| | Metallographic structure at center portion in sheet width direction | | | | | | | | | |
|---|---|---|---|---|---|---|---|---|---|---|
| Manufacturing No. | Tempered martensite + bainite (area %) | Ferrite (area %) | Pearlite (area %) | Residual austenite ($\gamma$) (area %) | Martensite (area %) | C concentration in residual austenite ($C_{\gamma C}$) (mass %) | Average grain size (μm) | Average number density of iron-based carbides ($10^6$ carbides/mm$^2$) | Sheet thickness (mm) | Remarks |
| 1 | 84.0 | 3.0 | 4.0 | 6.0 | 3.0 | 1.5 | 4.8 | 9.4 | 1.3 | Invention Example |
| 2 | 86.0 | 0.0 | 0.0 | 14.0 | 0.0 | 1.5 | 4.5 | 8.4 | 1.3 | Invention Example |
| 3 | 91.0 | 0.0 | 0.0 | 9.0 | 0.0 | 1.1 | 7.9 | 7.1 | 1.8 | Comparative Example |
| 4 | 79.0 | 8.0 | 0.0 | 13.0 | 0.0 | 1.1 | 5.3 | 7.7 | 1.9 | Comparative Example |
| 5 | 85.0 | 0.0 | 0.0 | 15.0 | 0.0 | 1.2 | 7.3 | 9.2 | 3.6 | Comparative Example |
| 6 | 78.0 | 7.0 | 0.0 | 15.0 | 0.0 | 1.1 | 4.3 | 7.8 | 3.4 | Comparative Example |
| 7 | 85.0 | 0.0 | 9.0 | 6.0 | 0.0 | 1.2 | 4.7 | 7.5 | 1.5 | Comparative Example |
| 8 | 87.0 | 0.0 | 6.0 | 7.0 | 0.0 | 1.1 | 4.8 | 8.7 | 2.7 | Comparative Example |
| 9 | 91.0 | 0.0 | 0.0 | 9.0 | 0.0 | 0.3 | 5.2 | 20.6 | 2.3 | Comparative Example |
| 10 | 98.0 | 0.0 | 0.0 | 2.0 | 0.0 | 1.2 | 4.9 | 7.1 | 3.1 | Comparative Example |
| 11 | 99.0 | 0.0 | 0.0 | 1.0 | 0.0 | 0.4 | 4.4 | 7.1 | 2.2 | Comparative Example |
| 12 | 98.0 | 0.0 | 0.0 | 2.0 | 0.0 | 0.4 | 4.7 | 5.5 | 3.4 | Comparative Example |
| 13 | 95.0 | 0.0 | 0.0 | 5.0 | 0.0 | 0.2 | 4.9 | 8.1 | 1.9 | Comparative Example |
| 14 | 78.0 | 0.0 | 4.0 | 11.0 | 7.0 | 1.4 | 5.5 | 8.4 | 2.3 | Invention Example |
| 15 | 96.0 | 0.0 | 0.0 | 4.0 | 0.0 | 1.4 | 4.8 | 8.9 | 3.4 | Invention Example |
| 16 | 88.0 | 0.0 | 0.0 | 12.0 | 0.0 | 1.5 | 4.5 | 9.2 | 3.0 | Invention Example |
| 17 | 86.0 | 4.0 | 2.0 | 8.0 | 0.0 | 1.3 | 4.4 | 6.3 | 3.8 | Invention Example |
| 18 | 85.0 | 0.0 | 0.0 | 6.0 | 9.0 | 1.1 | 5.5 | 8.5 | 3.6 | Invention Example |
| 19 | 91.0 | 0.0 | 0.0 | 9.0 | 0.0 | 1.1 | 5.5 | 7.0 | 3.3 | Invention Example |
| 20 | 78.0 | 0.0 | 0.0 | 17.0 | 5.0 | 1.5 | 4.8 | 7.5 | 1.7 | Invention Example |
| 21 | 89.0 | 0.0 | 0.0 | 11.0 | 0.0 | 1.5 | 5.6 | 7.2 | 3.0 | Invention Example |
| 22 | 91.0 | 0.0 | 0.0 | 9.0 | 0.0 | 1.1 | 4.9 | 7.3 | 2.3 | Invention Example |
| 23 | 91.0 | 0.0 | 0.0 | 9.0 | 0.0 | 1.4 | 5.6 | 9.1 | 4.0 | Invention Example |
| 24 | 86.0 | 0.0 | 0.0 | 14.0 | 0.0 | 1.1 | 4.9 | 7.2 | 3.9 | Invention Example |
| 25 | 91.0 | 0.0 | 0.0 | 9.0 | 0.0 | 1.2 | 4.4 | 10.0 | 3.1 | Invention Example |
| 26 | 85.0 | 0.0 | 0.0 | 15.0 | 0.0 | 1.3 | 5.0 | 7.2 | 3.7 | Invention Example |
| 27 | 70.0 | 28.0 | 0.0 | 2.0 | 0.0 | 1.4 | 4.7 | 9.7 | 2.6 | Comparative Example |
| 28 | 61.0 | 0.0 | 38.0 | 1.0 | 0.0 | 1.4 | 5.1 | 8.1 | 2.5 | Comparative Example |

TABLE 7-continued

| Manufacturing No. | Metallographic structure at center portion in sheet width direction: Tempered martensite + bainite (area %) | Ferrite (area %) | Pearlite (area %) | Residual austenite (γ) (area %) | Martensite (area %) | C concentration in residual austenite ($C_{\gamma C}$) (mass %) | Average grain size (μm) | Average number density of iron-based carbides ($10^6$ carbides/mm$^2$) | Sheet thickness (mm) | Remarks |
|---|---|---|---|---|---|---|---|---|---|---|
| 29 | 100.0 | 0.0 | 0.0 | 0.0 | 0.0 | 0.0 | 4.6 | 7.4 | 1.9 | Comparative Example |
| 30 | 75.0 | 14.0 | 0.0 | 11.0 | 0.0 | 1.4 | 5.5 | 6.5 | 3.7 | Comparative Example |
| 31 | 86.0 | 0.0 | 0.0 | 2.0 | 12.0 | 1.2 | 5.3 | 9.2 | 2.1 | Comparative Example |
| 32 | 91.0 | 0.0 | 0.0 | 9.0 | 0.0 | 1.1 | 4.8 | 7.5 | 2.6 | Comparative Example |
| 33 | 85.0 | 0.0 | 0.0 | 15.0 | 0.0 | 1.4 | 4.9 | 8.0 | 1.6 | Comparative Example |
| 34 | 100.0 | 0.0 | 0.0 | 0.0 | 0.0 | — | 7.3 | 6.0 | 2.9 | Comparative Example |
| 35 | 88.0 | 0.0 | 0.0 | 12.0 | 0.0 | 1.2 | 4.8 | 0.5 | 1.3 | Comparative Example |
| 36 | 80.0 | 4.0 | 0.0 | 16.0 | 0.0 | 1.2 | 5.0 | 7.0 | 2.9 | Comparative Example |
| 37 | 83.0 | 6.0 | 0.0 | 11.0 | 0.0 | 1.3 | 5.4 | 9.3 | 2.0 | Comparative Example |

TABLE 8

| Manufacturing No. | Structure change in sheet width direction: γ (area %) | $\gamma_{D1}$ (area %) | $\gamma_{D2}$ (area %) | $\gamma_{W1}$ (area %) | $\gamma_{W2}$ (area %) | $\gamma/\gamma_{D1}$ (—) | $\gamma/\gamma_{D2}$ (—) | $\gamma/\gamma_{W1}$ (—) | $\gamma/\gamma_{W2}$ (—) | Remarks |
|---|---|---|---|---|---|---|---|---|---|---|
| 1 | 6.0 | 5.5 | 6.4 | 6.1 | 6.2 | 1.1 | 0.9 | 1.0 | 1.0 | Invention Example |
| 2 | 14.0 | 13.4 | 12.7 | 13.7 | 13.7 | 1.0 | 1.1 | 1.0 | 1.0 | Invention Example |
| 3 | 9.0 | 8.3 | 8.3 | 9.7 | 9.5 | 1.1 | 1.1 | 0.9 | 0.9 | Comparative Example |
| 4 | 13.0 | 13.0 | 13.9 | 12.5 | 12.5 | 1.0 | 0.9 | 1.0 | 1.0 | Comparative Example |
| 5 | 15.0 | 14.9 | 16.4 | 15.9 | 14.3 | 1.0 | 0.9 | 0.9 | 1.0 | Comparative Example |
| 6 | 15.0 | 16.4 | 13.7 | 14.9 | 16.2 | 0.9 | 1.1 | 1.0 | 0.9 | Comparative Example |
| 7 | 6.0 | 5.8 | 6.0 | 5.6 | 6.0 | 1.0 | 1.0 | 1.1 | 1.0 | Comparative Example |
| 8 | 7.0 | 7.4 | 6.4 | 7.6 | 6.9 | 0.9 | 1.1 | 0.9 | 1.0 | Comparative Example |
| 9 | 9.0 | 9.6 | 9.2 | 8.8 | 8.4 | 0.9 | 1-0 | 1.0 | 1.1 | Comparative Example |
| 10 | 2.0 | 2.1 | 2.0 | 1.8 | 1.9 | 1.0 | 1.0 | 1.1 | 1.1 | Comparative Example |
| 11 | 1.0 | 5.3 | 10.3 | 6.1 | 9.3 | 0.2 | 0.1 | 0.2 | 0.1 | Comparative Example |
| 12 | 2.0 | 7.8 | 10.0 | 8.2 | 10.4 | 0.3 | 0.2 | 0.2 | 0.2 | Comparative Example |
| 13 | 5.0 | 6.5 | 9.7 | 6.4 | 10.0 | 0.8 | 0.5 | 0.8 | 0.5 | Comparative Example |
| 14 | 11.0 | 11.8 | 11.2 | 9.9 | 10.1 | 0.9 | 1.0 | 1.1 | 1.1 | Invention Example |
| 15 | 4.0 | 3.8 | 4.3 | 3.6 | 3.6 | 1.1 | 0.9 | 1.4 | 1.1 | Invention Example |
| 16 | 12.0 | 11.8 | 12.0 | 11.2 | 11.9 | 1.0 | 1.0 | 1.1 | 1.0 | Invention Example |
| 17 | 8.0 | 8.2 | 7.4 | 8.3 | 7.3 | 1.0 | 1.1 | 1.0 | 1.1 | Invention Example |
| 18 | 6.0 | 6.2 | 5.9 | 6.5 | 6.0 | 1.0 | 1.0 | 0.9 | 1.0 | Invention Example |
| 19 | 9.0 | 9.5 | 8.6 | 8.7 | 9.4 | 0.9 | 1.0 | 1.0 | 1.0 | Invention Example |
| 20 | 17.0 | 15.3 | 18.2 | 18.2 | 17.3 | 1.1 | 0.9 | 0.9 | 1.0 | Invention Example |
| 21 | 11.0 | 10.2 | 10.8 | 11.2 | 9.9 | 1.1 | 1.0 | 1.0 | 1.1 | Invention Example |
| 22 | 9.0 | 8.4 | 9.7 | 8.5 | 9.6 | 1.1 | 0.9 | 1.1 | 0.9 | Invention Example |
| 23 | 9.0 | 8.3 | 8.1 | 8.4 | 8.6 | 1.1 | 1.1 | 1.1 | 1.0 | Invention Example |
| 24 | 14.0 | 14.6 | 15.4 | 13.0 | 13.7 | 1.0 | 0.9 | 1.1 | 1.0 | Invention Example |
| 25 | 9.0 | 9.2 | 9.5 | 8.6 | 9.4 | 1.0 | 0.9 | 1.0 | 1.0 | Invention Example |
| 26 | 15.0 | 14.0 | 15.0 | 15.2 | 14.9 | 1.1 | 1.0 | 1.0 | 1.0 | Invention Example |
| 27 | 2.0 | 2.2 | 1.9 | 2.1 | 2.2 | 0.9 | 1.1 | 1.0 | 0.9 | Comparative Example |
| 28 | 1.0 | 1.1 | 0.9 | 1.1 | 1.0 | 0.9 | 1.1 | 0.9 | 1.0 | Comparative Example |
| 29 | 0.0 | 0.0 | 0.0 | 0.0 | 0.0 | — | — | — | — | Comparative Example |
| 30 | 11.0 | 10.2 | 10.0 | 11.0 | 10.1 | 1.1 | 1.1 | 1.0 | 1.1 | Comparative Example |
| 31 | 2.0 | 2.0 | 1.8 | 2.0 | 2.0 | 1.0 | 1.1 | 1.0 | 1.0 | Comparative Example |
| 32 | 9.0 | 7.0 | 5.6 | 6.8 | 6.2 | 1.3 | 1.6 | 1.3 | 1.5 | Comparative Example |
| 33 | 15.0 | 15.2 | 15.2 | 14.6 | 15.2 | 1.0 | 1.0 | 1.0 | 1.0 | Comparative Example |
| 34 | 0.0 | 0.0 | 0.0 | 0.0 | 0.0 | — | — | — | — | Comparative Example |
| 35 | 12.0 | 12.8 | 11.0 | 10.8 | 12.5 | 0.9 | 1.1 | 1.1 | 1.0 | Comparative Example |
| 36 | 14.0 | 10.0 | 10.8 | 9.2 | 10.0 | 1.4 | 1.3 | 1.5 | 1.4 | Comparative Example |
| 37 | 11.0 | 6.8 | 1.5 | 7.0 | 3.4 | 1.6 | 7.3 | 1.6 | 3.2 | Comparative Example |

TABLE 9

| Manufacturing No. | Structure change in sheet width direction: $C_{\gamma C}$ (mass %) | $C_{\gamma D1}$ (mass %) | $C_{\gamma D2}$ (mass %) | $C_{\gamma W1}$ (mass %) | $C_{\gamma W2}$ (mass %) | $C_{\gamma C}/C_{\gamma D1}$ (—) | $C_{\gamma C}/C_{\gamma D2}$ (—) | $C_{\gamma C}/C_{\gamma W1}$ (—) | $C_{\gamma C}/C_{\gamma W2}$ (—) | Remarks |
|---|---|---|---|---|---|---|---|---|---|---|
| 1 | 1.5 | 1.6 | 1.5 | 1.5 | 1.5 | 0.9 | 1.0 | 1.0 | 1.0 | Invention Example |
| 2 | 1.5 | 1.5 | 1.4 | 1.5 | 1.6 | 1.0 | 1.1 | 1.0 | 0.9 | Invention Example |
| 3 | 1.1 | 1.1 | 1.2 | 1.0 | 1.1 | 1.0 | 0.9 | 1.1 | 1.0 | Comparative Example |
| 4 | 1.1 | 1.2 | 1.1 | 1.2 | 1.0 | 0.9 | 1.0 | 0.9 | 1.1 | Comparative Example |

TABLE 9-continued

| Manufacturing No. | Structure change in sheet width direction | | | | | | | | | Remarks |
|---|---|---|---|---|---|---|---|---|---|---|
| | $C_{\gamma C}$ (mass %) | $C_{\gamma D1}$ (mass %) | $C_{\gamma D2}$ (mass %) | $C_{\gamma W1}$ (mass %) | $C_{\gamma W2}$ (mass %) | $C_{\gamma C}/C_{\gamma D1}$ (—) | $C_{\gamma C}/C_{\gamma D2}$ (—) | $C_{\gamma C}/C_{\gamma W1}$ (—) | $C_{\gamma C}/C_{\gamma W2}$ (—) | |
| 5 | 1.2 | 1.2 | 1.2 | 1.1 | 1.1 | 1.0 | 1.0 | 1.1 | 1.1 | Comparative Example |
| 6 | 1.1 | 1.2 | 1.2 | 1.2 | 1.1 | 0.9 | 0.9 | 0.9 | 1.0 | Comparative Example |
| 7 | 1.2 | 1.1 | 1.2 | 1.3 | 1.2 | 1.1 | 1.0 | 0.9 | 1.0 | Comparative Example |
| 8 | 1.1 | 1.2 | 1.1 | 1.0 | 1.1 | 0.9 | 1.0 | 1.1 | 1.0 | Comparative Example |
| 9 | 0.3 | 0.3 | 0.3 | 0.3 | 0.3 | 1.0 | 1.0 | 1.0 | 1.0 | Comparative Example |
| 10 | 1.2 | 1.2 | 1.2 | 1.3 | 1.2 | 1.0 | 1.0 | 0.9 | 1.0 | Comparative Example |
| 11 | 0.4 | 1.0 | 1.0 | 1.0 | 1.0 | 0.4 | 0.4 | 0.4 | 0.4 | Comparative Example |
| 12 | 0.4 | 0.7 | 0.9 | 0.8 | 1.0 | 0.6 | 0.4 | 0.5 | 0.4 | Comparative Example |
| 13 | 0.2 | 1.0 | 1.0 | 1.1 | 0.8 | 0.2 | 0.2 | 0.2 | 0.3 | Comparative Example |
| 14 | 1.4 | 1.3 | 1.3 | 1.4 | 1.5 | 1.1 | 1.1 | 1.0 | 0.9 | Invention Example |
| 15 | 1.4 | 1.5 | 1.3 | 1.3 | 1.5 | 0.9 | 1.1 | 1.1 | 0.9 | Invention Example |
| 16 | 1.5 | 1.4 | 1.7 | 1.5 | 1.4 | 1.1 | 0.9 | 1.0 | 1.1 | Invention Example |
| 17 | 1.3 | 1.3 | 1.4 | 1.4 | 1.2 | 1.0 | 0.9 | 0.9 | 1.1 | Invention Example |
| 18 | 1.1 | 1.0 | 1.1 | 1.0 | 1.1 | 1.1 | 1.0 | 1.1 | 1.0 | Invention Example |
| 19 | 1.1 | 1.2 | 1.0 | 1.1 | 1.2 | 0.9 | 1.1 | 1.0 | 0.9 | Invention Example |
| 20 | 1.5 | 1.6 | 1.4 | 1.6 | 1.6 | 0.9 | 1.1 | 0.9 | 0.9 | Invention Example |
| 21 | 1.5 | 1.5 | 1.4 | 1.6 | 1.5 | 1.0 | 1.1 | 0.9 | 1.0 | Invention Example |
| 22 | 1.1 | 1.0 | 1.0 | 1.0 | 1.1 | 1.1 | 1.1 | 1.1 | 1.0 | Invention Example |
| 23 | 1.4 | 1.5 | 1.5 | 1.4 | 1.3 | 0.9 | 0.9 | 1.0 | 1.1 | Invention Example |
| 24 | 1.1 | 1.0 | 1.2 | 1.2 | 1.0 | 1.1 | 0.9 | 0.9 | 1.1 | Invention Example |
| 25 | 1.2 | 1.1 | 1.1 | 1.3 | 1.2 | 1.1 | 1.1 | 0.9 | 1.0 | Invention Example |
| 26 | 1.3 | 1.2 | 1.3 | 1.3 | 1.4 | 1.1 | 1.0 | 1.0 | 0.9 | Invention Example |
| 27 | 1.4 | 1.3 | 1.4 | 1.4 | 1.5 | 1.1 | 1.0 | 1.0 | 0.9 | Comparative Example |
| 28 | 1.4 | 1.4 | 1.5 | 1.5 | 1.4 | 1.0 | 0.9 | 0.9 | 1.0 | Comparative Example |
| 29 | 0.0 | 0.0 | 0.0 | 0.0 | 0.0 | — | — | — | — | Comparative Example |
| 30 | 1.4 | 1.3 | 1.3 | 1.5 | 1.4 | 1.1 | 1.1 | 0.9 | 1.0 | Comparative Example |
| 31 | 1.2 | 1.2 | 1.3 | 1.2 | 1.2 | 1.0 | 0.9 | 1.0 | 1.0 | Comparative Example |
| 32 | 1.1 | 1.1 | 1.2 | 1.2 | 1.1 | 1.0 | 0.9 | 0.9 | 1.0 | Comparative Example |
| 33 | 1.4 | 1.5 | 1.4 | 1.4 | 1.5 | 0.9 | 1.0 | 1.0 | 0.9 | Comparative Example |
| 34 | 0.0 | 0.0 | 0.0 | 0.0 | 0.0 | — | — | — | — | Comparative Example |
| 35 | 1.2 | 1.3 | 1.1 | 1.2 | 1.3 | 0.9 | 1.1 | 1.0 | 0.9 | Comparative Example |
| 36 | 1.2 | 1.4 | 1.2 | 1.2 | 1.2 | 0.9 | 1.0 | 1.0 | 1.0 | Comparative Example |
| 37 | 1.2 | 1.3 | 1.1 | 1.3 | 1.2 | 0.9 | 1.1 | 0.9 | 1.0 | Comparative Example |

Evaluation Method of Properties of Hot-Rolled Steel Sheet (1) Tensile Strength Properties Among the mechanical properties of the hot-rolled steel sheet, the tensile strength properties (tensile strength, total elongation) were evaluated according to JIS Z 2241: 2011. A test piece was a No. 5 test piece of JIS Z 2241: 2011. As the tensile test piece collection position, the center position in the sheet width direction, a position 300 mm from the center position in the sheet width direction to one end side in the sheet width direction (position A in Table 10), a position 600 mm from the center position in the sheet width direction to the one end side in the sheet width direction (position B in Table 10), a position 300 mm from the center position in the sheet width direction to the other end side in the sheet width direction (position C in Table 10), and a position 600 mm from the center position in the sheet width direction to the other end side in the sheet width direction (position D in Table 10) were set, and the direction vertical to the rolling direction was defined as the longitudinal direction.

In a case where (tensile strength TS (MPa))×(total elongation EL (%))≥19000 was satisfied at the center position in the sheet width direction, the steel sheet was determined to be as acceptable as a hot-rolled steel sheet having excellent strength and ductility. In addition, in a case where, when (tensile strength TS (MPa))×(total elongation EL (%)) at each of the center position in the sheet width direction, the position 300 mm from the center position in the sheet width direction to one end side in the sheet width direction (position A in Table 10), the position 600 mm from the center position in the sheet width direction to the one end side in the sheet width direction (position B in Table 10), the position 300 mm from the center position in the sheet width direction to the other end side in the sheet width direction (position C in Table 10), and the position 600 mm from the center position in the sheet width direction to the other end side in the sheet width direction (position D in Table 10) was $(TS\times EL)_C$, $(IS\times EL)_{D1}$, $(TS\times EL)_{D2}$, $(TS\times EL)_{W1}$, and $(TS\times EL)_{W2}$, $0.80\leq\{(TS\times EL)_C/(TS\times EL)_{D1}\}\leq 1.20$, $0.80\leq\{(TS\times EL)_C/(TS\times EL)_{D2}\}\leq 1.20$, $0.80\leq\{(TS\times EL)_C/(TS\times EL)_{W1}\}\leq 1.20$, and $0.80\leq\{(TS\times EL)_C/(TS\times EL)_{W2}\}\leq 1.20$ were satisfied, the steel sheet was determined to be acceptable as a hot-rolled steel sheet having a small variation in the sheet width direction.

(2) Hole Expansion Rate

The hole expansion rate of the hot-rolled steel sheet was evaluated by the hole expanding test method according to the Japan Iron and Steel Federation standard JFS T 1001-1996. The test piece was collected from the same position as the tensile test piece collection position, and a punched hole was provided with a cylindrical punch. In a case where (tensile strength TS (MPa))×(hole expansion rate λ (%)) ≥50000 was satisfied, the steel sheet was determined to be acceptable as a hot-rolled steel sheet having excellent strength and stretch flangeability.

(3) Low Temperature Toughness

The low temperature toughness of the hot-rolled steel sheet was measured by the Charpy test. The Charpy test was carried out according to JIS Z 2242: 2005, and the fracture appearance transition temperature was measured. Since the hot-rolled steel sheets manufactured in the examples had a sheet thickness of less than 10.0 mm, the front and back sides of a hot-rolled steel sheet having a sheet thickness of 2.5 mm or more were ground to 2.5 mm, and the front and back sides of a hot-rolled steel sheet having a sheet thickness of less than 2.5 mm were ground to 1.25 mm. Then, the Charpy test was performed. In a case where ductile-brittle transition temperature (vTrs) was −50° C. or lower, the steel sheet was determined to be acceptable as a hot-rolled steel sheet having excellent low temperature toughness.

The obtained measurement results are shown in Tables 10 and 11.

TABLE 10

| | Properties | | | | | | | | | | |
|---|---|---|---|---|---|---|---|---|---|---|---|
| Manufacturing No. | Tensile strength TS (MPa) | Total elongation EL (%) | Hole expansion rate λ (%) | TS × λ (%) | vTrs (° C.) | $(TS \times EL)_C$ at sheet width center position (MPa · %) | $(TS \times EL)_{D1}$ at position A (MPa · %) | $(TS \times EL)_{D2}$ at position B (MPa · %) | $(TS \times EL)_{W1}$ at position C (MPa · %) | $(TS \times EL)_{W2}$ at position D (MPa · %) | Remarks |
| 1 | 1077 | 18.3 | 59 | 63543 | −60 | 19709 | 19512 | 21483 | 20300 | 19906 | Invention Example |
| 2 | 1299 | 16.2 | 60 | 77940 | −80 | 21044 | 20623 | 22517 | 21044 | 21044 | Invention Example |
| 3 | 1350 | 16.3 | 52 | 70200 | −30 | 22005 | 20685 | 21565 | 20465 | 22665 | Comparative Example |
| 4 | 1130 | 18.4 | 41 | 46330 | −90 | 20792 | 23911 | 22871 | 21000 | 21208 | Comparative Example |
| 5 | 1296 | 16.8 | 57 | 73872 | −40 | 21773 | 22426 | 22861 | 21773 | 20466 | Comparative Example |
| 6 | 1125 | 18.6 | 38 | 42750 | −90 | 20925 | 23436 | 20925 | 23227 | 22181 | Comparative Example |
| 7 | 1288 | 14.8 | 35 | 45080 | −70 | 19062 | 16966 | 18872 | 18681 | 18681 | Comparative Example |
| 8 | 1314 | 15.0 | 36 | 47304 | −60 | 19710 | 21878 | 19513 | 20301 | 18922 | Comparative Example |
| 9 | 1280 | 12.5 | 63 | 80640 | −60 | 16000 | 18400 | 17440 | 15840 | 13600 | Comparative Example |
| 10 | 1285 | 12.7 | 55 | 70675 | −80 | 16320 | 17462 | 15340 | 15667 | 14851 | Comparative Example |
| 11 | 1326 | 12.1 | 53 | 70278 | −60 | 16045 | 21660 | 22462 | 22462 | 21821 | Comparative Example |
| 12 | 1285 | 12.7 | 59 | 75815 | −70 | 16320 | 21052 | 22521 | 22358 | 24642 | Comparative Example |
| 13 | 1281 | 12.0 | 55 | 70455 | −70 | 15372 | 21060 | 21828 | 20752 | 22289 | Comparative Example |
| 14 | 1170 | 16.7 | 50 | 58500 | −90 | 19539 | 19930 | 19148 | 20125 | 20125 | Invention Example |
| 15 | 1317 | 15.0 | 60 | 79020 | −60 | 19755 | 20545 | 20940 | 19360 | 19755 | Invention Example |
| 16 | 1288 | 15.2 | 55 | 70840 | −80 | 19578 | 19186 | 22123 | 19969 | 20361 | Invention Example |
| 17 | 992 | 20.1 | 69 | 68448 | −60 | 19939 | 19341 | 19540 | 22133 | 19142 | Invention Example |
| 18 | 1346 | 14.5 | 49 | 65954 | −90 | 19517 | 19127 | 19517 | 20298 | 19712 | Invention Example |
| 19 | 1324 | 16.3 | 46 | 60904 | −80 | 21581 | 24818 | 20286 | 21581 | 23524 | Invention Example |
| 20 | 1173 | 18.4 | 62 | 72726 | −90 | 21583 | 20936 | 23094 | 24821 | 22447 | Invention Example |
| 21 | 1283 | 16.6 | 59 | 75697 | −90 | 21298 | 20446 | 20233 | 21937 | 20446 | Invention Example |
| 22 | 1345 | 15.3 | 60 | 80700 | −60 | 20579 | 22636 | 20990 | 21607 | 21813 | Invention Example |
| 23 | 1301 | 16.8 | 58 | 75458 | −90 | 21857 | 20983 | 20108 | 21857 | 21201 | Invention Example |
| 24 | 1317 | 15.9 | 62 | 81654 | −60 | 20940 | 21359 | 24710 | 21359 | 20312 | Invention Example |
| 25 | 1361 | 15.7 | 56 | 76216 | −80 | 21368 | 20513 | 20513 | 21368 | 22009 | Invention Example |
| 26 | 1335 | 15.5 | 53 | 70755 | −80 | 20693 | 20072 | 20279 | 21520 | 21106 | Invention Example |
| 27 | 890 | 20.0 | 17 | 15130 | −70 | 17800 | 18868 | 16554 | 18512 | 18690 | Comparative Example |
| 28 | 1303 | 12.5 | 36 | 46908 | −70 | 16288 | 17265 | 15799 | 18731 | 15473 | Comparative Example |
| 29 | 1291 | 9.3 | 73 | 94243 | −70 | 12006 | 12847 | 11886 | 13087 | 11886 | Comparative Example |
| 30 | 1328 | 15.9 | 34 | 45152 | −90 | 21115 | 21749 | 20271 | 21749 | 20059 | Comparative Example |
| 31 | 1324 | 12.4 | 32 | 42368 | −80 | 16418 | 16253 | 15925 | 16746 | 16582 | Comparative Example |
| 32 | 1370 | 15.8 | 56 | 76720 | −60 | 21646 | 16018 | 14286 | 17100 | 14286 | Comparative Example |
| 33 | 1338 | 16.3 | 36 | 48168 | −70 | 21809 | 24208 | 23118 | 20065 | 22027 | Comparative Example |
| 34 | 1165 | 11.8 | 68 | 79220 | −80 | 13747 | 14086 | 13669 | 13860 | 14681 | Comparative Example |
| 35 | 1328 | 17.0 | 57 | 75696 | −30 | 22576 | 23642 | 22493 | 22648 | 21008 | Comparative Example |
| 36 | 1026 | 21.5 | 45 | 46170 | −60 | 22059 | 16879 | 17058 | 16442 | 14400 | Comparative Example |
| 37 | 1063 | 20.8 | 47 | 49961 | −60 | 22110 | 19836 | 14055 | 19066 | 14447 | Comparative Example |

TABLE 11

| | Properties | | | | |
|---|---|---|---|---|---|
| Manufacturing No. | $(TS \times EL)_C/(TS \times EL)_{D1}$ (—) | $(TS \times EL)_C/(TS \times EL)_{D2}$ (—) | $(TS \times EL)_C/(TS \times EL)_{W1}$ (—) | $(TS \times EL)_C/(TS \times EL)_{W2}$ (—) | Remarks |
| 1 | 1.01 | 0.92 | 0.97 | 0.99 | Invention Example |
| 2 | 1.02 | 0.93 | 1.00 | 1.00 | Invention Example |
| 3 | 1.06 | 1.02 | 1.08 | 0.97 | Comparative Example |
| 4 | 0.87 | 0.91 | 0.99 | 0.98 | Comparative Example |
| 5 | 0.97 | 0.95 | 1.00 | 1.06 | Comparative Example |
| 6 | 0.89 | 1.00 | 0.90 | 0.94 | Comparative Example |
| 7 | 1.12 | 1.01 | 1.02 | 1.02 | Comparative Example |
| 8 | 0.90 | 1.01 | 0.97 | 1.04 | Comparative Example |
| 9 | 0.87 | 0.92 | 1.01 | 1.18 | Comparative Example |
| 10 | 0.93 | 1.06 | 1.04 | 1.10 | Comparative Example |
| 11 | 0.74 | 0.71 | 0.71 | 0.74 | Comparative Example |
| 12 | 0.78 | 0.72 | 0.73 | 0.66 | Comparative Example |
| 13 | 0.73 | 0.70 | 0.74 | 0.69 | Comparative Example |
| 14 | 0.98 | 1.02 | 0.97 | 0.97 | Invention Example |
| 15 | 0.96 | 0.94 | 1.02 | 1.00 | Invention Example |
| 16 | 1.02 | 0.88 | 0.98 | 0.96 | Invention Example |

TABLE 11-continued

| Manufacturing No. | Properties | | | | Remarks |
|---|---|---|---|---|---|
| | $(TS \times EL)_C/(TS \times EL)_{D1}$ (—) | $(TS \times EL)_C/(TS \times EL)_{D2}$ (—) | $(TS \times EL)_C/(TS \times EL)_{W1}$ (—) | $(TS \times EL)_C/(TS \times EL)_{W2}$ (—) | |
| 17 | 1.03 | 1.02 | 0.90 | 1.04 | Invention Example |
| 18 | 1.02 | 1.00 | 0.96 | 0.99 | Invention Example |
| 19 | 0.87 | 1.06 | 1.00 | 0.92 | Invention Example |
| 20 | 1.03 | 0.93 | 0.87 | 0.96 | Invention Example |
| 21 | 1.04 | 1.05 | 0.97 | 1.04 | Invention Example |
| 22 | 0.91 | 0.98 | 0.95 | 0.94 | Invention Example |
| 23 | 1.04 | 1.09 | 1.00 | 1.03 | Invention Example |
| 24 | 0.98 | 0.85 | 0.98 | 1.03 | Invention Example |
| 25 | 1.04 | 1.04 | 1.00 | 0.97 | Invention Example |
| 26 | 1.03 | 1.02 | 0.96 | 0.98 | Invention Example |
| 27 | 0.94 | 1.08 | 0.96 | 0.95 | Comparative Example |
| 28 | 0.94 | 1.03 | 0.87 | 1.05 | Comparative Example |
| 29 | 0.93 | 1.01 | 0.92 | 1.01 | Comparative Example |
| 30 | 0.97 | 1.04 | 0.97 | 1.05 | Comparative Example |
| 31 | 1.01 | 1.03 | 0.98 | 0.99 | Comparative Example |
| 32 | 1.35 | 1.52 | 1.27 | 1.52 | Comparative Example |
| 33 | 0.90 | 0.94 | 1.09 | 0.99 | Comparative Example |
| 34 | 0.98 | 1.01 | 0.99 | 0.94 | Comparative Example |
| 35 | 0.95 | 1.00 | 1.00 | 1.07 | Comparative Example |
| 36 | 1.31 | 1.29 | 1.34 | 1.53 | Comparative Example |
| 37 | 1.11 | 1.57 | 1.16 | 1.53 | Comparative Example |

As can be seen from Tables 10 and 11, in Manufacturing Nos. 1, 2, and 14 to 26 as Invention Examples, a hot-rolled steel sheet having excellent strength, ductility, stretch flangeability, and low temperature toughness and having a material property variation in the sheet width direction could be obtained.

On the other hand, in Manufacturing Nos. 3 to 13 and 27 to 37 in which the chemical composition, the metallographic structure, the C concentration in the residual austenite, the average grain size of the metallographic structure excluding the residual austenite, and/or the number density of iron-based carbides having a diameter of 20 nm or more were not within the ranges defined in the present invention, one or more of the properties (tensile strength TS, total elongation EL, hole expansion rate γ, low temperature toughness (vTrs), and material property variation in the sheet width direction) were deteriorated.

INDUSTRIAL APPLICABILITY

According to the present invention, it is possible to provide a hot-rolled steel sheet having excellent strength, ductility, stretch flangeability, and low temperature toughness. In addition, according to a preferable aspect of the present invention, it is possible to provide a hot-rolled steel sheet having the above-mentioned various properties and having a material property variation in the sheet width direction.

The hot-rolled steel sheet according to the present invention is suitable as an industrial material used for vehicle members, mechanical structural members, and building members.

What is claimed is:

1. A hot-rolled steel sheet comprising, as a chemical composition, by mass %:

C: 0.100% to 0.250%;
Si: 0.05% to 3.00%;
Mn: 1.00% to 4.00%;
Nb: 0.005% to 0.050%;
sol. Al: 0.001% to 2.000%;
P: 0.100% or less;
S: 0.0300% or less;
N: 0.1000% or less;
0: 0.0100% or less;
Ti: 0% to 0.300%;
V: 0% to 0.500%;
Cu: 0% to 2.00%;
Cr: 0% to 2.00%;
Mo: 0% to 1.000%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or two or more of Zr, Co, Zn, and W: 0% to 1.00% in total;
Sn: 0% to 0.050%; and
a remainder including Fe and impurities,
wherein a metallographic structure at a sheet thickness ¼ depth from a surface and at a center position in a sheet width direction in a sheet width cross section parallel to a rolling direction contains, by area %,
77.0% to 94.0% of bainite and tempered martensite in total,
0% to 5.0% of ferrite,
0% to 5.0% of pearlite,
6.0% or more of residual austenite, and
0% to 10.0% of martensite,
an average grain size of the metallographic structure excluding the residual austenite is 7.0 μm or less,
a C concentration in the residual austenite is 0.5 mass % or more, and
a number density of iron-based carbides having a diameter of 20 nm or more is $1.0\times10^6$ carbides/$mm^2$ or more.

2. The hot-rolled steel sheet according to claim 1,
wherein in a case where area fractions of residual austenite in metallographic structures, in the sheet width cross section parallel to the rolling direction,
at the sheet thickness ¼ depth from the surface and at the center position in the sheet width direction, at the sheet thickness ¼ depth from the surface and at a position 300 mm from the center position in the sheet width direction to one end side in the sheet width direction, at the sheet thickness ¼ depth from the surface and at a position 600 mm from the center position in the sheet width direction to the one end side in the sheet width direction, at the sheet thickness ¼ depth from the surface and at a position 300 mm from the center position in the sheet width direction to the other end side in the sheet width direction, and at the sheet thickness ¼ depth from the surface and at a position 600 mm from the center position in the sheet width direction to the other end side in the sheet width direction are respectively denoted by $\gamma$, $\gamma_{D1}$, $\gamma_{D2}$, $\gamma_{W1}$, and $\gamma_{W2}$ in terms of area %, $\gamma/\gamma_{D1}$, $\gamma/\gamma_{D2}$, $\gamma/\gamma_{W1}$, and $\gamma/\gamma_{W2}$ are each 0.8 or more and less than 1.2, and in a case where C concentrations in the residual austenite in the metallographic structures, at the sheet thickness ¼ depth from the surface and at the center position in the sheet width direction, at the sheet thickness ¼ depth from the surface and at the position 300 mm from the center position in the sheet width direction to the one end side in the sheet width direction, at the sheet thickness ¼ depth from the surface and at the position 600 mm from the center position in the sheet width direction to the one end side in the sheet width direction, at the sheet thickness ¼ depth from the surface and at the position 300 mm from the center position in the sheet width direction to the other end side in the sheet width direction, and at the sheet thickness ¼ depth from the surface and at the position 600 mm from the center position in the sheet width direction to the other end side in the sheet width direction are respectively denoted by $C\gamma_C$, $C\gamma_{D1}$, $C\gamma_{D2}$, $C\gamma_{W1}$, and $C\gamma_{W2}$ in terms of mass %, $C\gamma_C/C\gamma_{D1}$, $C\gamma_C/C\gamma_{D2}$, $C\gamma_C/C\gamma_{W1}$, and $C\gamma_C/Cy_{W2}$ are each 0.8 or more and less than 1.2.

3. The hot-rolled steel sheet according to claim 1, wherein the hot-rolled steel sheet includes, as the chemical composition, by mass %, one or two or more selected from the group consisting of Ti: 0.005% to 0.300%,
V: 0.005% to 0.500%,
Cu: 0.01% to 2.00%,
Cr: 0.01% to 2.00%,
Mo: 0.010% to 1.000%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

4. The hot-rolled steel sheet according to claim 2, wherein the hot-rolled steel sheet includes, as the chemical composition, by mass %, one or two or more selected from the group consisting of Ti: 0.005% to 0.300%,
V: 0.005% to 0.500%,
Cu: 0.01% to 2.00%,
Cr: 0.01% to 2.00%,
Mo: 0.010% to 1.000%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

5. The hot-rolled steel sheet according to claim 1, wherein the C concentration in the residual austenite is 0.7 mass % or more.

* * * * *